US011815838B2

(12) United States Patent
Kim et al.

(10) Patent No.: US 11,815,838 B2
(45) Date of Patent: Nov. 14, 2023

(54) STRUCTURE FOR ADJUSTING PAPER PATH GAP USING THE ROLLER MOVING ACCORDING TO THE THICKNESS OF THE PAPER

(71) Applicant: HEWLETT-PACKARD DEVELOPMENT COMPANY, L.P., Spring, TX (US)

(72) Inventors: Wonkook Kim, Seongnam-si (KR); Hogun You, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/908,979

(22) PCT Filed: Mar. 5, 2021

(86) PCT No.: PCT/US2021/021083
§ 371 (c)(1),
(2) Date: Sep. 2, 2022

(87) PCT Pub. No.: WO2021/183383
PCT Pub. Date: Sep. 16, 2021

(65) Prior Publication Data

US 2023/0102754 A1 Mar. 30, 2023

(30) Foreign Application Priority Data

Mar. 12, 2020 (KR) ..... 10-2020-0030648

(51) Int. Cl.
*G03G 15/16* (2006.01)
*G03G 15/00* (2006.01)
(Continued)

(52) U.S. Cl.
CPC ..... *G03G 15/5029* (2013.01); *B65H 5/068* (2013.01); *B65H 5/36* (2013.01); *G03G 15/167* (2013.01); *B65H 2511/13* (2013.01)

(58) Field of Classification Search
CPC ..... G03G 15/5029; G03G 15/167; G03G 15/1665; B65H 5/068; B65H 5/36
(Continued)

(56) References Cited

U.S. PATENT DOCUMENTS 6,381,423 B1 * 4/2002 Eom ..... G03G 15/167 271/265.04
7,664,445 B2 * 2/2010 Nishida ..... G03G 15/165 399/45
(Continued)

FOREIGN PATENT DOCUMENTS

JP 06-263331 A 9/1994
JP 2002-148965 A 5/2002
(Continued)

*Primary Examiner* — Quana Grainger
(74) *Attorney, Agent, or Firm* — Foley & Lardner LLP

(57) ABSTRACT

An image forming apparatus comprising includes an image carrying member including a movable surface to include a toner image; a transfer roller to form a transfer nip between the transfer roller and the movable surface of the image carrying member, to move position in a direction in correspondence to a thickness of a print medium to intersect a direction of introduction of the print medium into the transfer nip, and to receive a transfer bias voltage to transfer the toner image from the movable surface of the image carrying member to the print medium; and a movement guide structure to guide the print medium toward the transfer nip, and to move in synchronization with the movement of the position of the transfer roller to change a gap between an end of the movement guide structure facing the image carrying member and the image carrying member.

13 Claims, 27 Drawing Sheets

(51) Int. Cl.
*B65H 5/06* (2006.01)
*B65H 5/36* (2006.01)

(58) Field of Classification Search
USPC ..... 399/45
See application file for complete search history.

(56) References Cited

U.S. PATENT DOCUMENTS

| | | | | |
|---|---|---|---|---|
| 2003/0113134 | A1 | 6/2003 | Oba et al. | |
| 2012/0134723 | A1* | 5/2012 | Nojima | B65H 5/38 271/272 |
| 2015/0008640 | A1 | 1/2015 | Kambayashi | |
| 2015/0108714 | A1 | 4/2015 | Wakabayashi et al. | |
| 2016/0282785 | A1* | 9/2016 | Totsuka | G03G 15/6558 |

FOREIGN PATENT DOCUMENTS

| | | | |
|---|---|---|---|
| JP | 2007-302393 | A | 11/2007 |
| JP | 2016-180847 | A | 10/2016 |
| KR | 10-2001-0074356 | A | 8/2001 |

* cited by examiner

STRUCTURE FOR ADJUSTING PAPER PATH GAP USING THE ROLLER MOVING ACCORDING TO THE THICKNESS OF THE PAPER

BACKGROUND

An image forming apparatus prints an image on a print medium transferred along a transfer path by a transfer roller. For example, an electrophotographic image forming apparatus scans a photoconductor charged with a uniform electric potential to form an electrostatic latent image, and supplies toner to the electrostatic latent image to form a toner image on the photoconductor. The toner image is transferred to a print medium which is transferred along a transfer path. When the print medium passes through a fixing portion, the toner image is fixed to the print medium as a permanent image by heat and pressure.

The image forming apparatus includes a guide structure that guides the print medium to be transferred smoothly along the transfer path. The guide structure has a certain gap from adjacent components in view of manufacturing tolerances, transfer of a print medium, or transfer of a toner image.

However, a step (or height difference) may occur due to the gap, which may affect the transfer path of the print medium.

DETAILED DESCRIPTION

Figure 1:
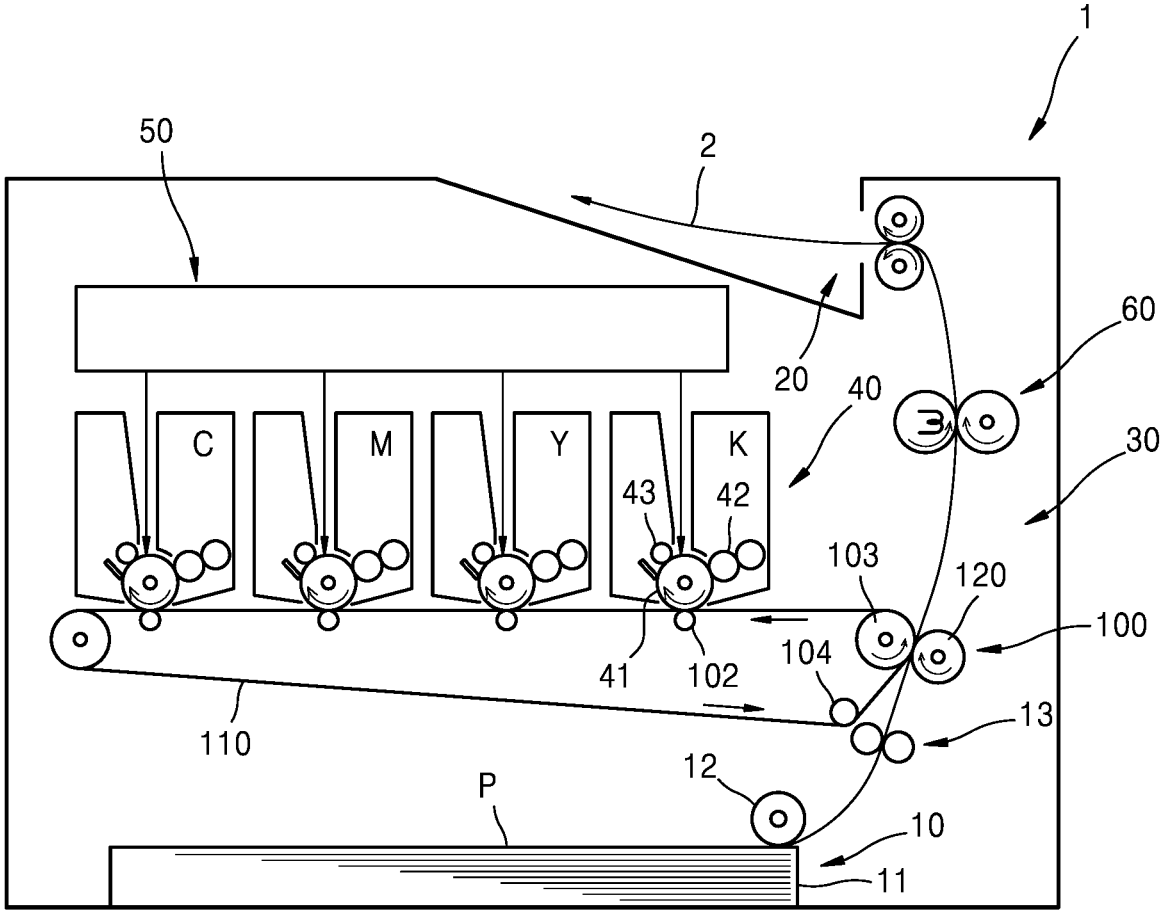
FIG. 1 is a configuration diagram of an example of an image forming apparatus according to an example.

Hereinafter, examples of a finisher will be described with reference to the accompanying drawings. The same reference numerals refer to the same elements throughout. In the drawings, the sizes of constituent elements may be exaggerated for clarity.

FIG. 1 is a schematic configuration diagram of an example of an image forming apparatus 1 according to an example.

Referring to FIG. 1, the image forming apparatus 1 shows a paper feeder 10 on which a print medium is loaded, and a paper discharger 20 on which a print medium on which printing has been completed is loaded. A printing path 2 connects the paper feeder 10 to the paper discharger 20. An image forming unit 30 is arranged in the printing path 2.

Print media P loaded on the paper feeder 10 are withdrawn from the paper feeder 10 one by one and transferred along the printing path 2. In the present example, the paper feeder 10 is in the form of a cassette feeder, but the example of the paper feeder 10 is not limited thereto.

The image forming unit 30 prints an image by an electrophotographic method on a print medium P transferred along the printing path 2. The image forming unit 30 may include a developing unit 40, an exposure unit 50, a transfer unit 100, and a fixing unit 60.

The image forming unit 30 of the present example may selectively print a monochrome image and a color image on the print medium P.

For color printing, the developing unit 40 may include four developing units 40 for developing images of, for example, cyan (C), magenta (M), yellow (Y), and black (K). Each of the four developing units 40 may include a developer, for example, toner having a color of cyan, magenta, yellow, or black. The cyan, magenta, yellow, and black toners are respectively contained in four toner supply containers (not shown), and the cyan, magenta, yellow, and black toners may be supplied to the four developing units 40 from the four toner supply containers. The image forming apparatus 1 may further include a developer for accommodating and developing toners of various colors, such as light magenta and white, in addition to the above-described colors. The toner supply container may be replaced when the contained toner is exhausted. The developing unit 40 may be detachably attached to the image forming apparatus 1 through a door (not shown).

Hereinafter, the image forming unit 30 having the four developing units 40 will be described, and reference numerals with C, M, Y, and K refer to components for developing images of colors C, M, Y, and K, respectively, unless otherwise specified.

The developing unit 40 supplies toner contained therein to a latent electrostatic image formed in a photosensitive drum 41.

The photosensitive drum 41 is an example of a photoconductor on which an electrostatic latent image is formed, and may include a conductive metal pipe and a photosensitive layer formed on the periphery thereof. A charging roller 43 charges the surface of the photosensitive drum 41 with a uniform electric potential.

The exposure unit 50 irradiates light modulated corresponding to image information onto the photosensitive drum 41 to form an electrostatic latent image on the photosensitive drum 41. As the exposure unit 50, a laser scanning unit (LSU) using a laser diode as a light source, a light emitting diode (LED) exposure unit using an LED as a light source, and the like may be employed.

A developing roller 42 is for developing an electrostatic latent image into a visible toner image by supplying a developer, for example, toner, accommodated in the developing unit 40 to the photosensitive drum 41. A developing bias voltage may be applied to the developing roller 42. When a one-component developing method is employed, toner may be accommodated in the developing unit 40. When a two-component developing method is employed, toner and a carrier may be accommodated in the developing unit 40. Although not shown in the drawings, the developing unit 40 may further include a supply roller for supplying a developer accommodated in the developing unit 40 to the developing roller 42, a regulating member attached to the surface of the developing roller 42 to regulate the amount of developer supplied to a developing area where the photosensitive drum 41 and the developing roller 42 face each other, and a stirring member of the developer accommodated in the developing unit 40.

The transfer unit 100 may include an intermediate transfer belt 110, an intermediate transfer roller 102, and a transfer roller 120. A toner image developed on a photosensitive drum 41 of each of developing units 40C, 40M, 40Y, and 40K is transferred to the intermediate transfer belt 110 intermittently. The intermediate transfer belt 110 is supported by support rollers 103 and 104 and circulated.

A toner image is formed on the surface of the intermediate transfer belt 110. The surface of the intermediate transfer belt 110 on which the toner image is formed is movable toward the transfer roller 120. The intermediate transfer belt 110 functions as an image carrying member that carries a toner image.

Four intermediate transfer rollers 102 are arranged at positions facing the photosensitive drum 41 of each of the developing units 40C, 40M, 40Y, and 40K with the intermediate transfer belt 110 therebetween. An intermediate transfer bias voltage for intermediate transfer of the toner image developed on the photosensitive drum 41 to the intermediate transfer belt 110 is applied to the four intermediate transfer rollers 102. Instead of the intermediate transfer roller 102, a corona transfer unit or a pin scorotron transfer unit may be employed. The transfer roller 120 is located facing the intermediate transfer belt 110. The transfer roller 120 is applied with a transfer bias voltage for transferring a toner image intermediately transferred to the intermediate transfer belt 110 to the print medium P.

When the transfer bias voltage is applied to the transfer roller 120, the toner images superimposed on the intermediate transfer belt 110 are transferred to the print medium P.

The fixing unit 60 applies heat and pressure to the print medium P to which the toner images have been transferred, thereby fixing the toner images to the print medium P. The fixing unit 60 may be implemented in various forms. For example, the fixing unit 60 may include a heating member and a pressing member. The heating member and the pressing member are elastically pressed to each other to form a fixing nip. The heating member may be implemented in the form of, for example, a heating roller or a fixing belt. The heating member is heated by a heat source, such as, for example, a halogen lamp. The heating member is in contact with an image surface of the print medium P. The image surface is a surface to which a toner image has been transferred. When the print medium P to which the toner image has been transferred passes through a fixing nip, the toner image is fixed to the print medium P by heat and pressure. Thus, a recorded image may be formed on the print medium P in the image forming unit 30.

A pick-up roller 12 withdraws the print media P one by one from a feeder 11. A conveying roller 13 transfers the withdrawn print medium P along a transfer path. The conveying roller 13 may include a pair of rollers that transfer the print medium P while being engaged with each other and rotated. The conveying roller 13 aligns front ends of the print media P and transfers them to a transfer nip according to timing at which front ends of a toner image transferred to the intermediate transfer belt 110 reach a transfer nip formed by the transfer roller 120 and the intermediate transfer belt 110. The conveying roller 13 is called a registration roller. "Aligning the front ends of the print media P" means correcting the skew of the print medium P.

Figure 2:
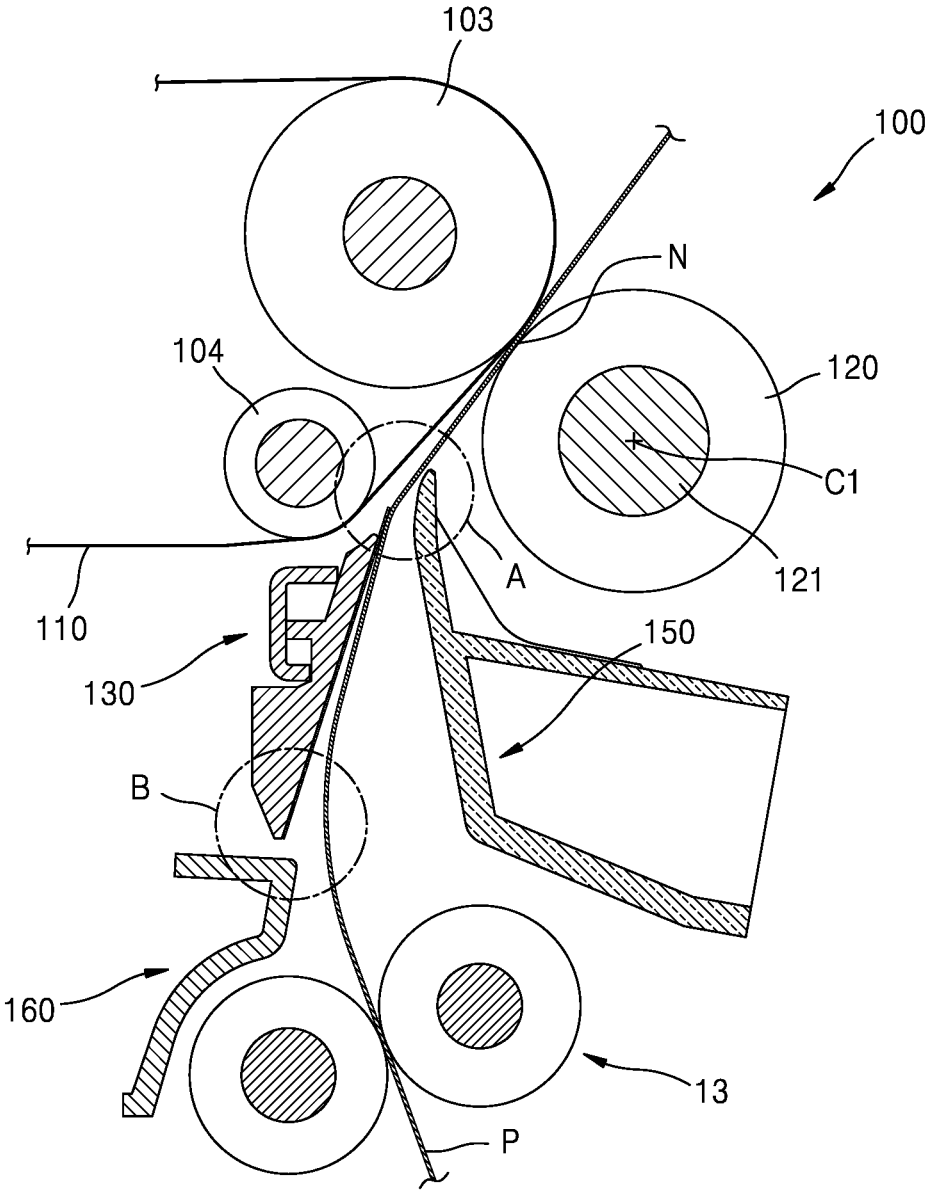
FIG. 2 is a view for explaining an operation of a transfer unit of an image forming apparatus according to an example.
Figure 3:
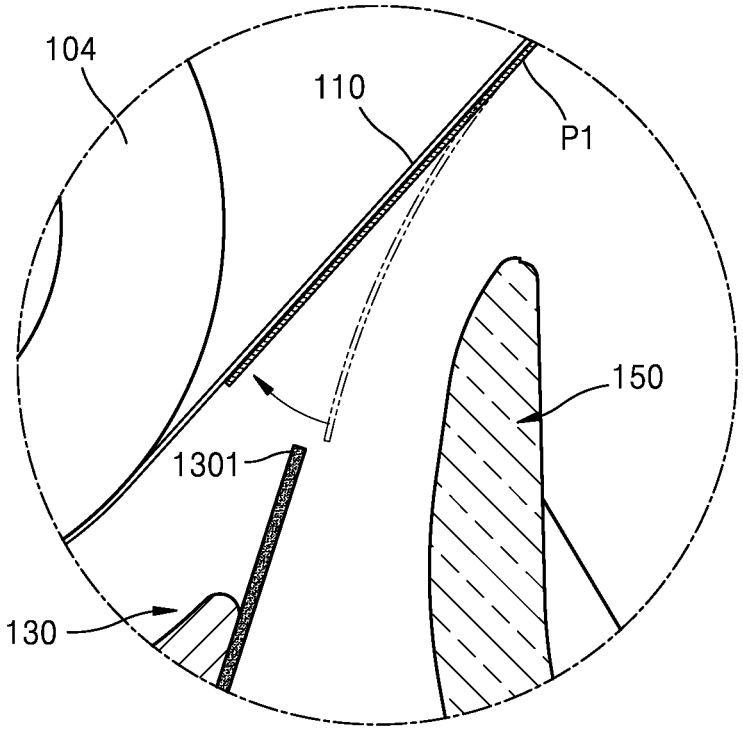
FIG. 3 is an enlarged view of portion A of the example of FIG. 2.
Figure 4:
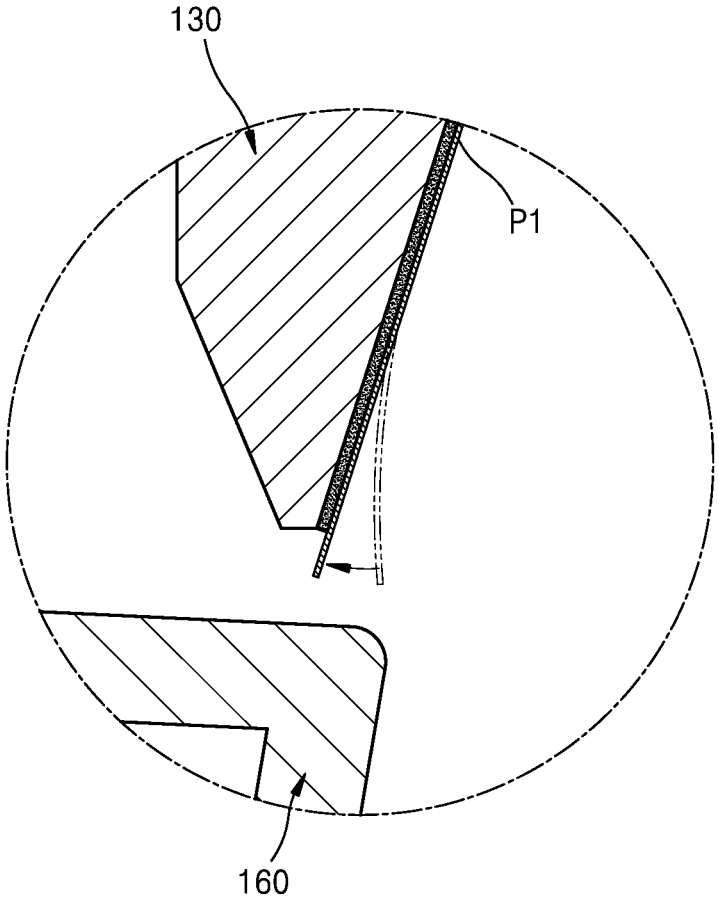
FIG. 4 is an enlarged view of portion B of the example of FIG. 2.

FIG. 2 is an example of a view for conceptually explaining the operation of the transfer unit 100 of the image forming apparatus 1 according to an example. FIGS. 3 and 4 are examples of enlarged views of portion A and portion B of FIG. 2, respectively.

Referring to FIG. 2, a guide structure for guiding the print medium P may be arranged between a transfer nip N and the conveying roller 13 such that the print medium P is transferred to the transfer nip N.

The guide structure may be plural. That is, there may be more than one guide structure or the guide structure may have more than one member. The guide structure may include a movement guide structure 130 arranged to face a first surface on which a toner image is formed on the print medium P and a guide structure 150 arranged to face a second surface opposite to the first surface in the print medium P. A gap between the movement guide structure 130 and the guide structure 150 gradually decreases along a transfer path of the print medium P. A guide structure 160 may be additionally arranged between the movement guide structure 130 and the conveying roller 13.

The movement guide structure 130 guides the print medium P transferred through the conveying roller 13 to change the direction so as to face the transfer nip N. The guide structure 150 may guide the print medium P so as to prevent the print medium P having a changed direction from colliding with the transfer roller 120 other than the transfer nip N.

Accordingly, even if a curved path is included in the transfer path between the conveying roller 13 and the transfer nip N, by a plurality of guide structures, the transfer medium P may reach the transfer nip N without hitting other structures.

The movement guide structure 130 has a certain distance from adjacent components, and a predetermined step (e.g., height difference) may be formed therebetween. For example, the movement guide structure 130 is arranged to have a predetermined distance from the intermediate transfer belt 110 to prevent contact with a surface of the intermediate transfer belt 110. Accordingly, a step may be formed between the movement guide structure 130 and the intermediate transfer belt 110.

In addition, the movement guide structure 130 is arranged at a predetermined distance from the guide structure 160, and a predetermined step may be formed therebetween. The predetermined step may prevent the print medium from being caught in the movement guide structure 130 during a process of moving the print medium from another guide structure 160 to the movement guide structure 130.

However, when these gaps or steps are greater than a predetermined size, image defects may be introduced during a process of transferring image toner to the print medium P.

For example, as shown in FIG. 3, in a process of a print medium P1 passing through the movement guide structure 130 to the transfer nip N, a rear end of the print medium P1 passes between the movement guide structure 130 and the intermediate transfer belt 110. The print medium P1 has elasticity. While the rear end of the print medium P1 is supported by an end 1301 of the movement guide structure 130, the print medium P1 is elastically bent as shown by dashed lines in FIG. 3 due to a step between the movement guide structure 130 and the intermediate transfer belt 110. The moment the rear end of the print medium P1 passes the end 1301 of the movement guide structure 130, as shown by solid lines in FIG. 3, the print medium P1 is restored to being straight by the elasticity of the print medium P1, and the rear end of the print medium P1 contacts the intermediate transfer belt 110 by an elastic restoring force. At this time, vibration may occur at the rear end of the print medium P1.

In addition, as shown in FIG. 4, in a process in which the rear end of the print medium P1 is withdrawn from the conveying roller 13 and moves toward the transfer nip N, the rear end of the print medium P1 passes between the guide structure 160 and the movement guide structure 130. The moment the rear end of the print medium P1 passes an end of the guide structure 160, while the print medium P1 is restored straight as shown by solid lines in FIG. 4 in a state of being elastically bent as shown by dashed lines in FIG. 4, the rear end of the print medium P1 contacts the movement guide structure 130. At this time, vibration may occur at the rear end of the print medium P1.

Figure 5:
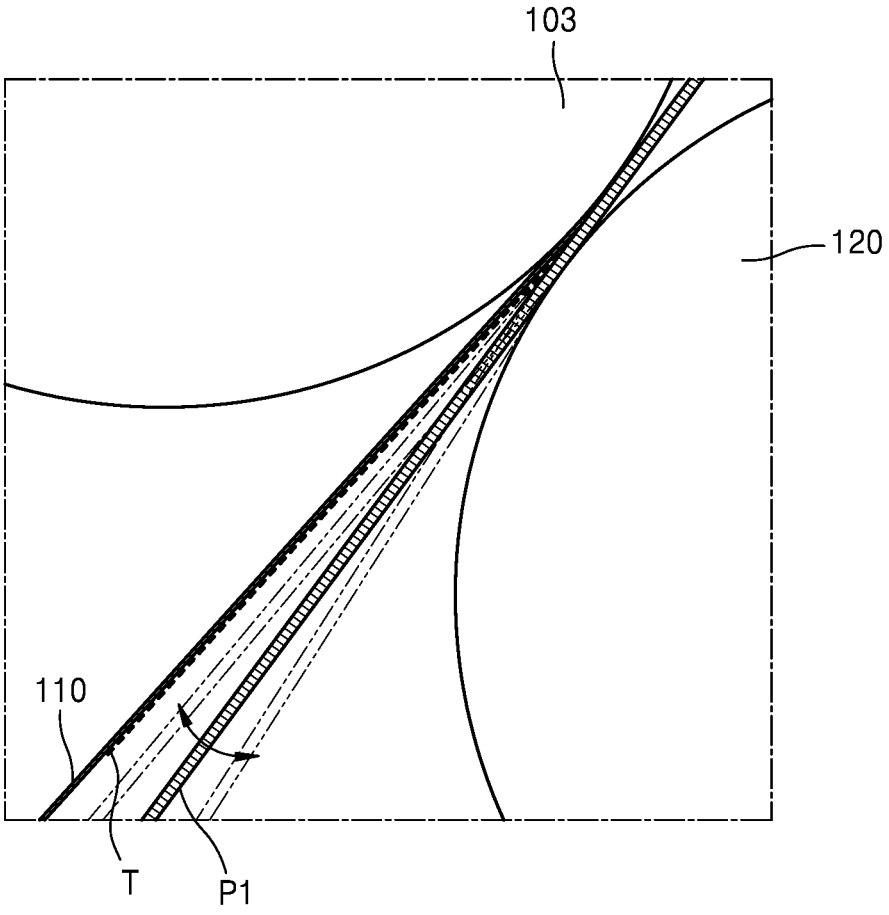
FIG. 5 is a view of an example for explaining a phenomenon in which vibration of a print medium affects a toner image.
Figure 6:
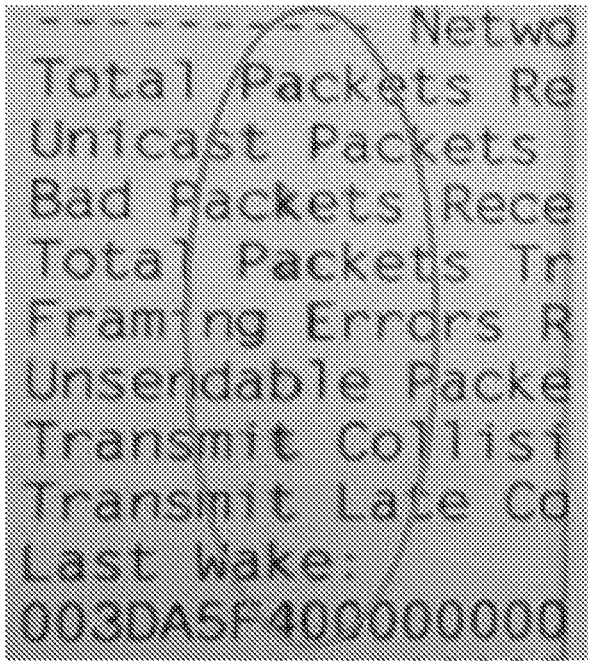
FIGS. 6 and 7 are photographs showing an example of an appearance of an effect on a toner image.
Figure 7:
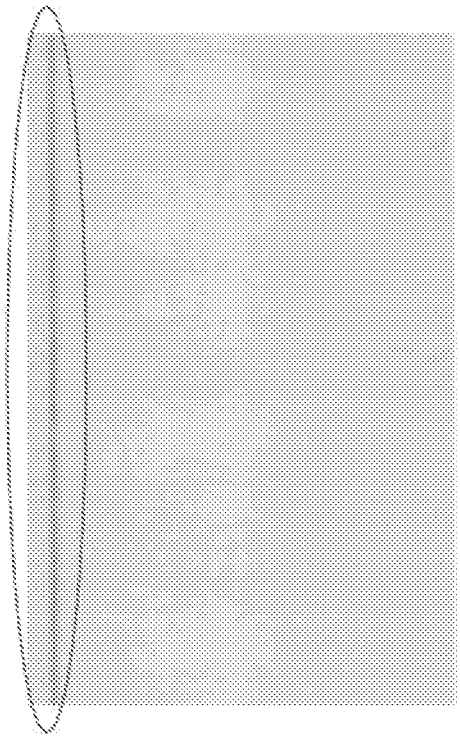

As such, the vibration occurring at the rear end of the print medium P1 may be transmitted to a portion of the print medium P1 adjacent to the transfer nip N, as shown in FIG. 5. The vibration may affect a toner image T of the intermediate transfer belt 110 or affect a transfer process in which the toner image T is transferred to the print medium P, resulting in image defects in a printed image. For example, as illustrated in FIG. 6, some lines of text may appear as crushed in a transferred toner image, or as illustrated in FIG. 7, a band may appear in some areas of the print medium P1.

To prevent such unintended image defects, a gap between the movement guide structure 130 and adjacent components is minimized. For example, it is possible to consider a structure that reduces a gap between the end 1301 of the movement guide structure 130 and the intermediate transfer belt 110.

However, when fixing the movement guide structure 130 by reducing the gap between the end 1301 of the movement guide structure 130 and the intermediate transfer belt 110, unintended image defects may appear in a process of forming an image on a thick print medium P2.

The print medium P used in the image forming apparatus 1 may have various thicknesses and weights. The weight of the print medium P is expressed as basis weight. Hereinafter, a general print medium is indicated by P1, and a thick print medium is indicated by P2.

For example, the general print medium P1 may have a first thickness t1 and predetermined basis weight. For example, a thickness of the general print medium P1 may be about 0.3 mm or less. Also for example, a thickness of the general print medium P1 may be about 0.2 mm or less. For example, the general print medium P1 may have a thickness of about 0.1 mm to about 0.2 mm, and the basis weight may be 60 $g/m^2$ to 120 $g/m^2$.

For example, the thick print medium P2 may have a second thickness t2 greater than the first thickness t1, and may have basis weight greater than that of the general print medium P1. For example, the thick print medium P2 has a thickness exceeding 0.3 mm, and the basis weight may be more than 120 $g/m^2$. For example, the thick print medium P2 may have a thickness of about 0.4 mm and basis weight of 325 $g/m^2$.

Figure 8A:
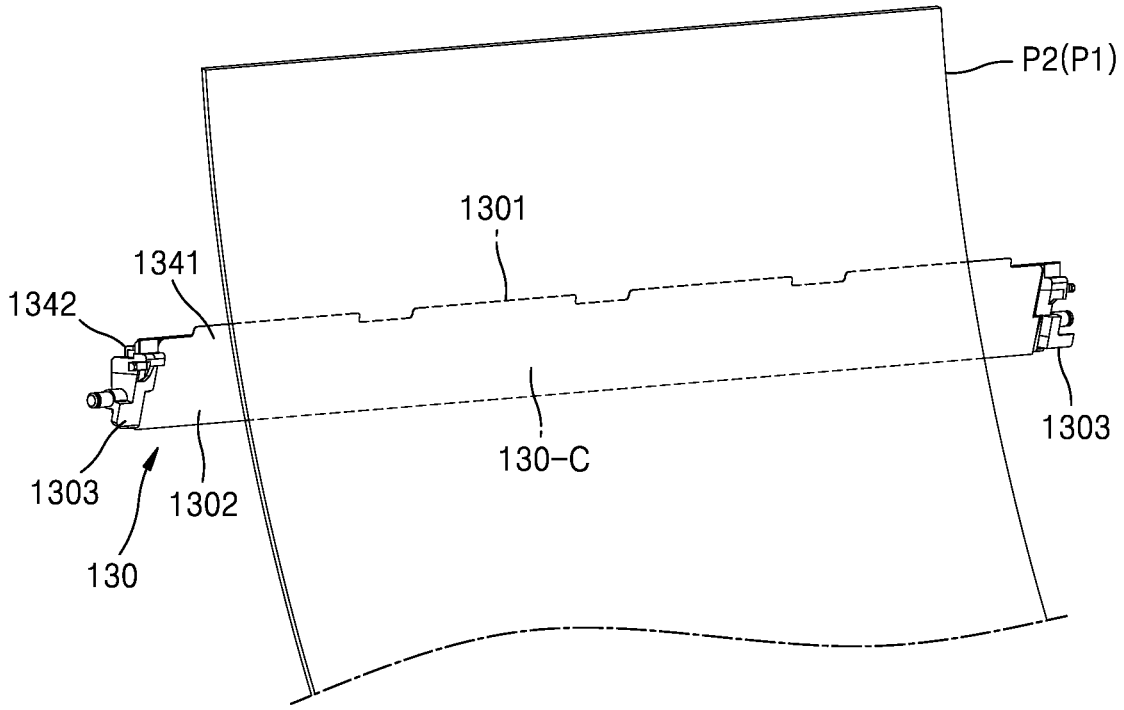
FIG. 8A is a view for explaining an example of a movement guide structure.
Figure 8B:
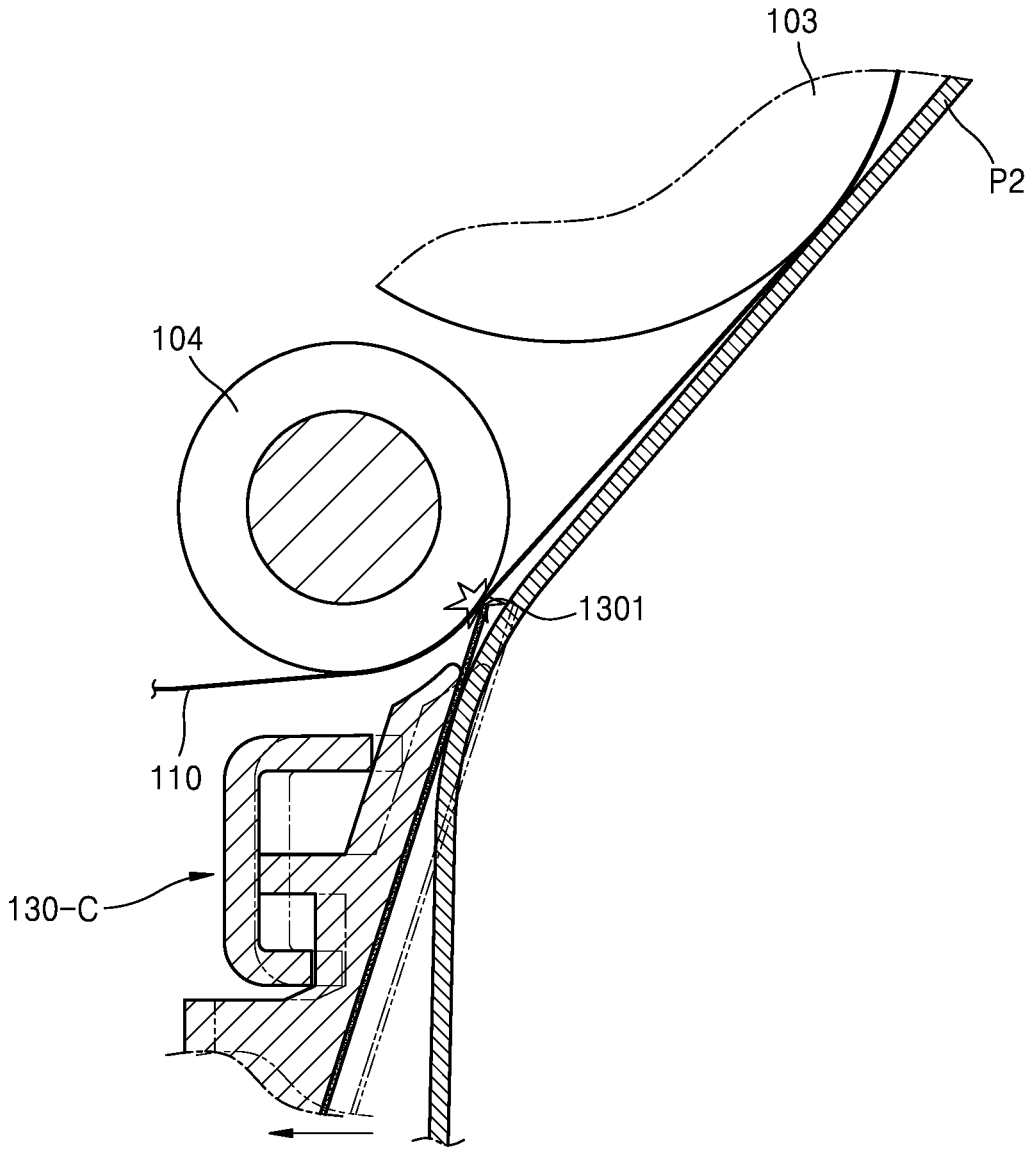
FIG. 8B is a view for explaining an example of a state in which a thick print medium passes through the movement guide structure of FIG. 8A.
Figure 9:
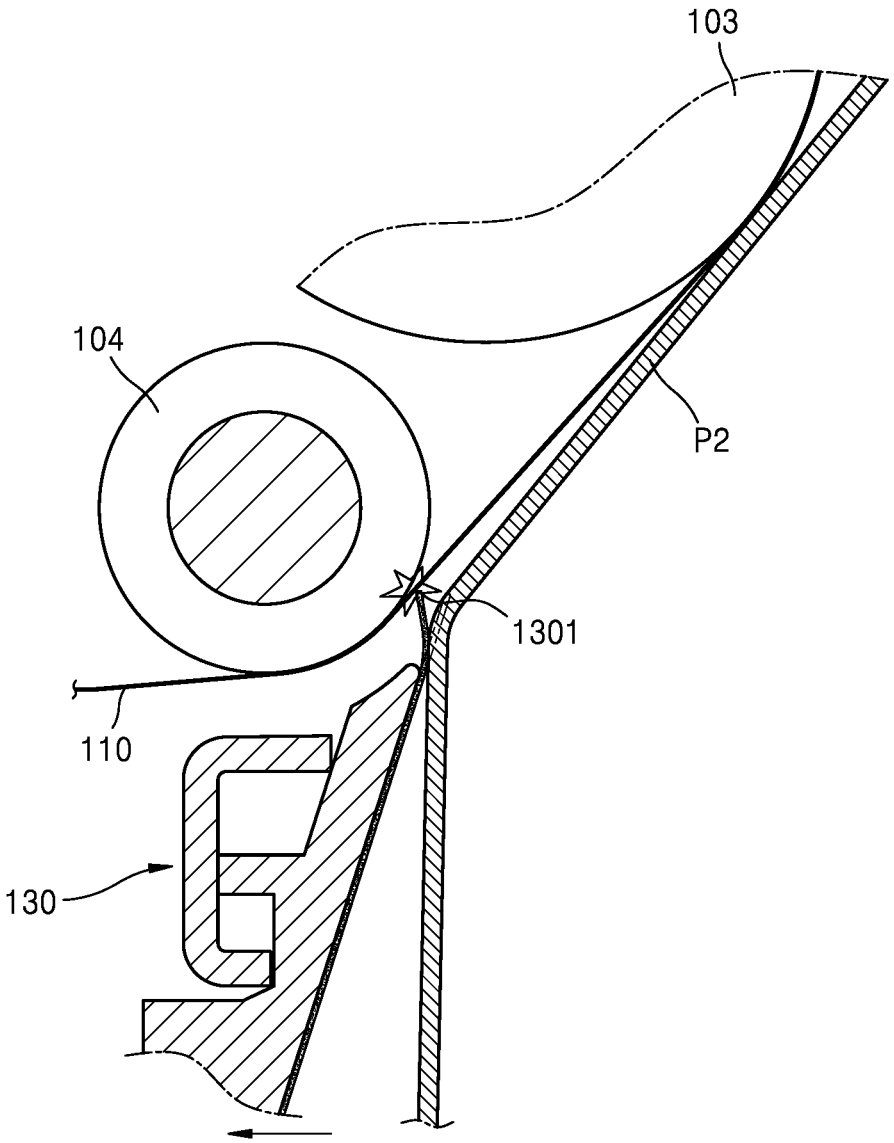
FIG. 9 is an example of a view for explaining a state in which a thick print medium passes through a guide structure.

FIGS. 8A and 8B and 9 are examples of views for explaining a state in which the thick print medium P2 passes through a guide structure.

Referring to FIG. 8A, the movement guide structure 130 includes a guide portion 1302 for guiding movement of the print media P1 and P2 along a surface and a support portion 1303 for supporting the guide portion 1302 to be located at a predetermined position. The support portion 1303 is arranged at both ends of the guide portion 1302. As such, both ends of the movement guide structure 130 are supported in a width direction of the print medium P2.

In a process by which the print media P1 and P2 is guided and moved by the movement guide structure 130, a predetermined force acts on the guide portion 1302 by the print media P1 and P2. In particular, because an intermediate portion 130-C of the movement guide structure 130 is far from the support portion 1303, the intermediate portion 130-C is relatively easily bent by an external force.

When the thick print medium P2 is guided and moved by the movement guide structure 130, a predetermined force acts on the movement guide structure 130 due to the thick print medium P2. Because the basis weight of the thick print medium P2 is greater than that the basis weight of a general print medium P1, a force exerted by the thick print medium P2 on the movement guide structure 130 is greater than a force exerted by the general print medium P1 on the movement guide structure 130.

As a predetermined force is applied to the relatively flexible movement guide structure 130 due to the thick print medium P2, the intermediate portion 130-C of the movement guide structure 130 may be bent from a state shown by a two-dot chain line in FIG. 8B to a state shown by a solid line in FIG. 8B. Even if the degree of bending is small, when a gap between the movement guide structure 130 and the intermediate transfer belt 110 is small, as shown in FIG. 8B, the end 1301 of the movement guide structure 130 may contact the intermediate transfer belt 110.

In addition, even if the intermediate portion 130-C of the movement guide structure 130 is not bent, the end 1301 of the movement guide structure 130 may be bent from a state shown by a two-dot chain line in FIG. 9 to a state shown by a solid line in FIG. 9. For example, when the end 1301 of the movement guide structure 130 is thinner than other portions, the end 1301 of the movement guide structure 130 may be bent. Even if the degree of bending is small, when the gap between the movement guide structure 130 and the intermediate transfer belt 110 is small, as shown in FIG. 9, the bent end 1301 of the movement guide structure 130 may contact a surface of the intermediate transfer belt 110.

Figure 10:
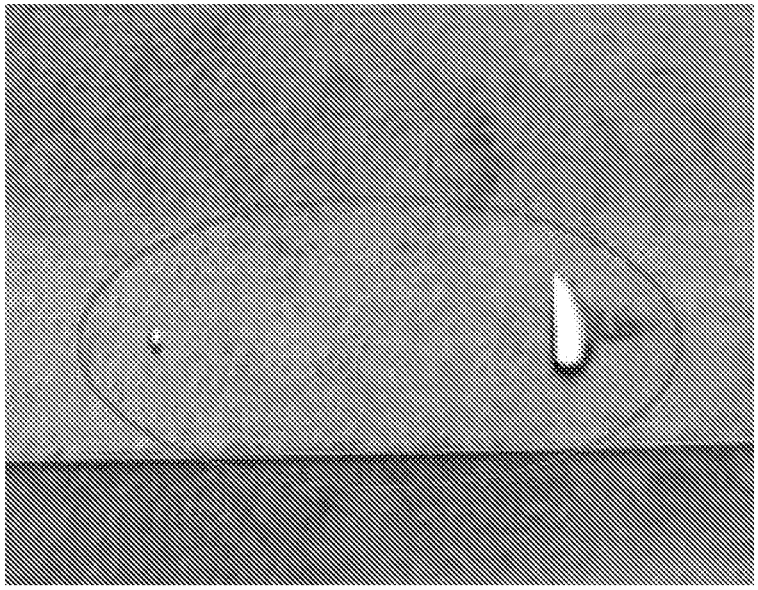
FIG. 10 is a photograph showing an example of a recorded image formed on a thick print medium.

When the movement guide structure 130 contacts the surface of the intermediate transfer belt 110, serious image defects may occur. For example, when the end 1301 of the movement guide structure 130 contacts the surface of the intermediate transfer belt 110, the toner image T is scratched. Accordingly, when the toner image T is transferred to the print medium P2, as shown in FIG. 10, a phenomenon in which some areas are omitted in a recorded image formed on the print medium P2 may appear.

In view of this, when the print medium P2 is thick, in order to prevent the movement guide structure 130 from contacting the surface of the intermediate transfer belt 110 even if a portion of the movement guide structure 130 is bent, the gap between the movement guide structure 130 and the intermediate transfer belt 110 is arranged to be a predetermined size or more.

As such, with respect to the gap between the end 1301 of the movement guide structure 130 and the intermediate transfer belt 110, conditions placed when the print medium P is the general print medium P1 and conditions placed when the print medium P is the thick print medium P2 conflict with each other.

Considering that contrary conditions are placed according to a change in the thickness of the print medium P, the image forming apparatus 1 according to an example may have a structure to change the gap between the end 1301 of the movement guide structure 130 and the intermediate transfer belt 110 according to the change in the thickness of the print medium P.

For example, the transfer roller 120 may move in a direction intersecting a withdrawal direction of the print medium P according to the thickness of the print medium P introduced into the transfer nip N, and the gap between the end 1301 of the movement guide structure 130 and the intermediate transfer belt 110 may change according to a positional movement of the transfer roller 120.

According to an example, the image forming apparatus 1 includes an image carrying member (the intermediate transfer belt 110) in which a toner image is arranged on a movable surface, the transfer roller 120 facing the image carrying member 110 and moving in a direction that intersects a direction of introduction of the print medium P in correspondence to the thickness of the print medium P, wherein a transfer bias voltage is applied such that the toner image arranged on the image carrying member 110 is transferred to the print medium P, and the movement guide structure 130 for guiding the print medium P to be transferred toward the transfer nip N formed between the image transfer member and the transfer roller 120, wherein the gap between the end 1301 facing the image carrying member 110 and the image carrying member 110 is changed as the movement guide structure 130 moves in synchronization with positional movement of the transfer roller 120.

Figure 11A:
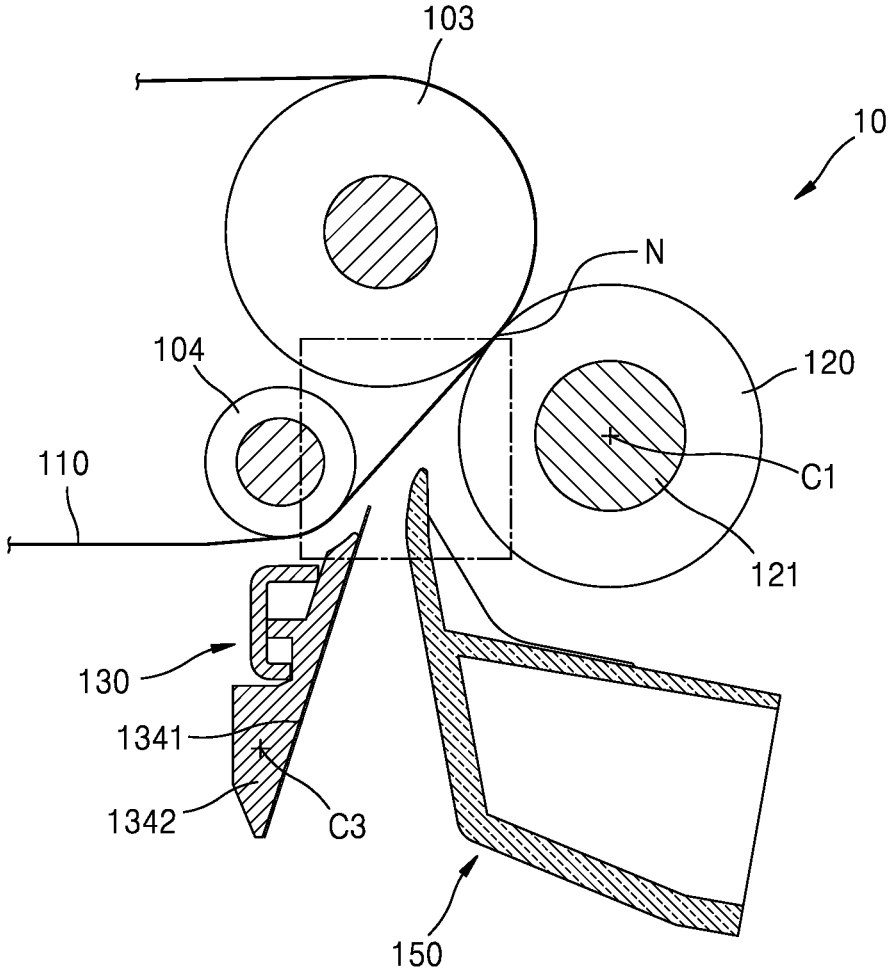
FIG. 11A is a view for explaining an operation of a movement guide structure in an image forming apparatus according to an example.
Figure 11B:
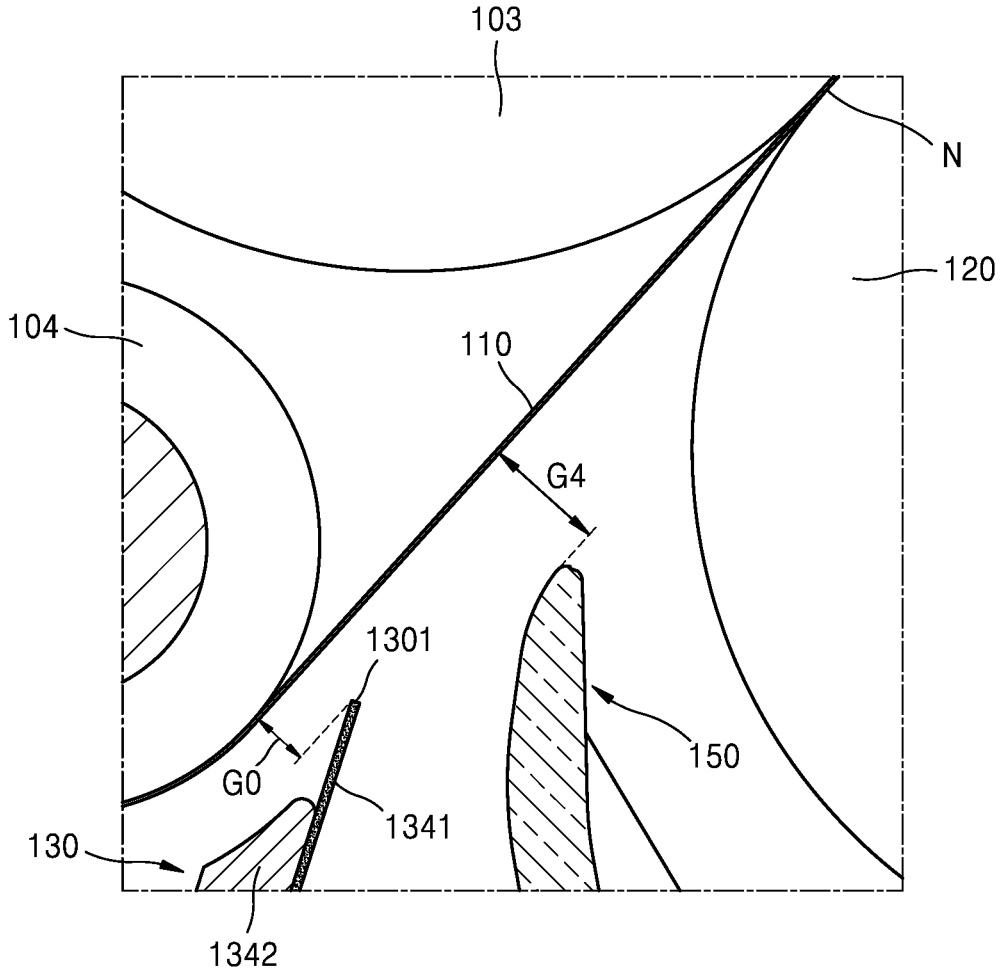
FIG. 11B is an enlarged view of a portion of the example of FIG. 11A.
Figure 12A:
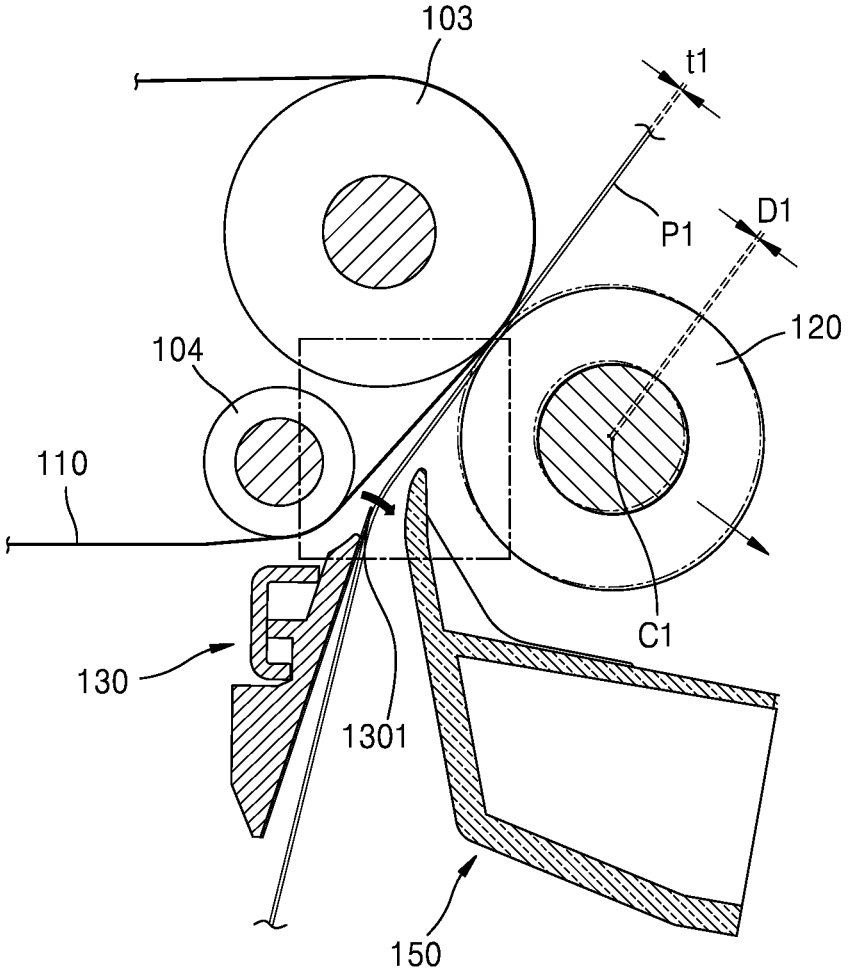
FIG. 12A is a view for explaining an operation of a movement guide structure when a general print medium passes through an image forming apparatus according to an example.
Figure 12B:
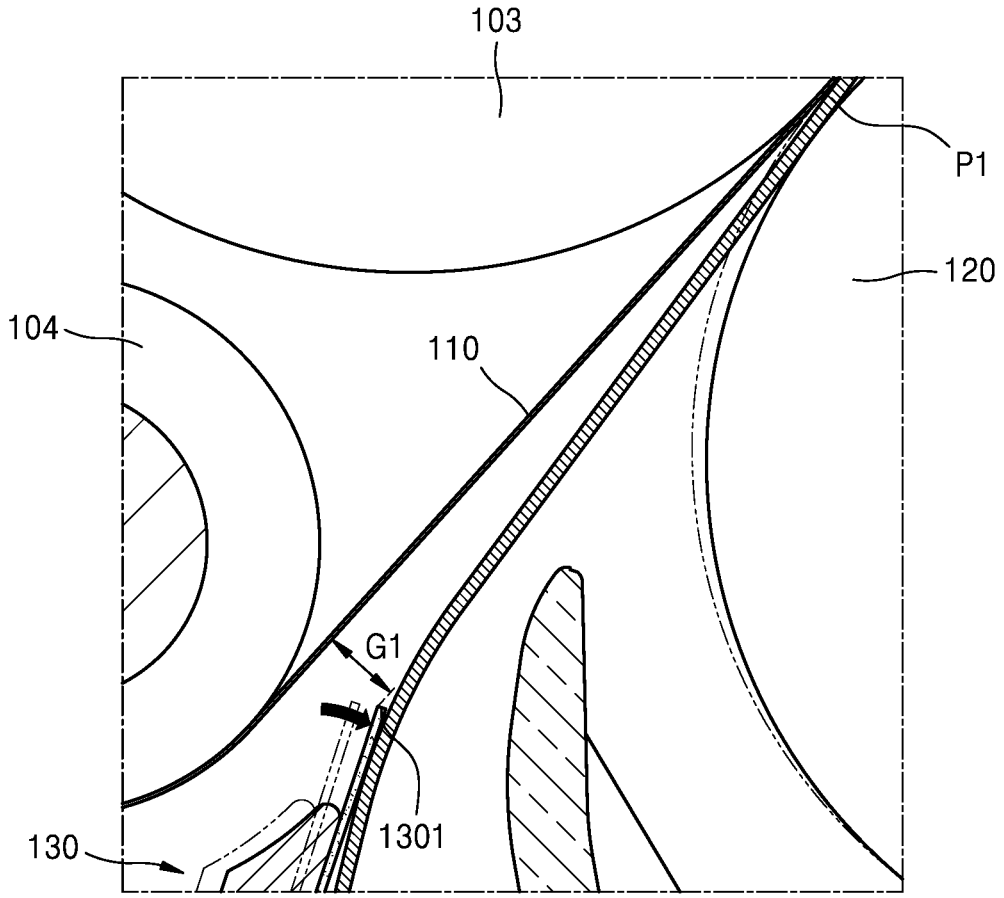
FIG. 12B is an enlarged view of a portion of the example of FIG. 12A.
Figure 13A:
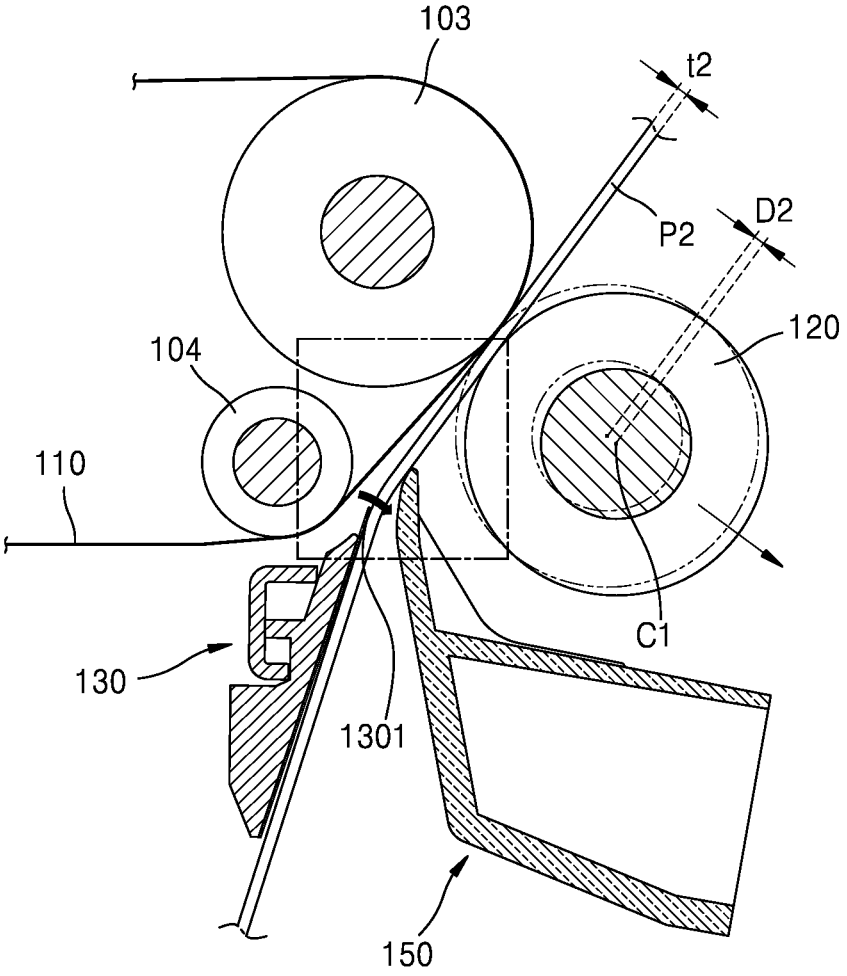
FIG. 13A is a view for explaining an operation of a movement guide structure when a thick print medium passes through an image forming apparatus according to an example.

FIGS. 11A to 13B are views for explaining an operation of the transfer roller 120 and the movement guide structure 130 in the image forming apparatus 1 according to an example, wherein FIGS. 11A and 11B show an operation when no print medium is introduced into the transfer nip N, FIGS. 12A and 12B show an operation when the print medium P1 is introduced into the transfer nip N, and FIGS. 13A and 3B show an operation when the print medium P2 is introduced into the transfer nip N.

Referring to FIGS. 11A and 11B, when the print medium P is not introduced into the transfer nip N, the transfer roller 120 contacts the intermediate transfer belt 110. The gap between the movement guide structure 130 and the intermediate transfer belt 110 may have a reference gap G0. The reference gap G0 may be about 0.5 mm to about 1.3 mm.

As the thickness of the print medium P introduced into the transfer nip N is thicker, the gap between the end 1301 of the movement guide structure 130 and the intermediate transfer belt 110 may be increased.

Referring to FIGS. 12A and 12B, when the print medium P1 having the first thickness t1 is introduced into the transfer nip N, the transfer roller 120 and the intermediate transfer belt 110 are apart from each other by the first thickness t1. A rotation center of the transfer roller 120 moves by a first distance D1 corresponding to the first thickness t1. The first distance D1 may be equal to or less than the first thickness t1. The first distance D1 may vary depending on elasticity of an outer surface of the transfer roller 120.

As the transfer roller 120 moves by the first distance D1, the gap between the movement guide structure 130 and the intermediate transfer belt 110 may have a first gap G1. The first gap G1 may be about 0.7 mm to about 1.5 mm.

Figure 13B:
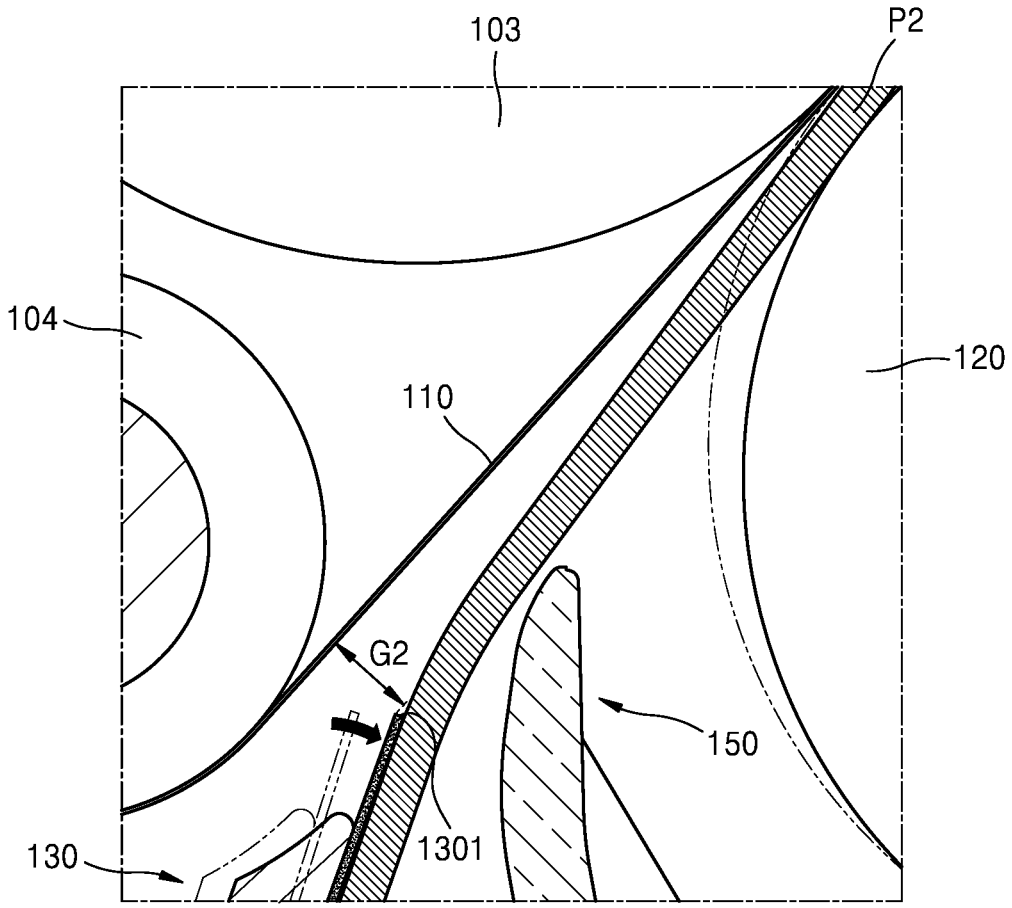
FIG. 13B is an enlarged view of a portion of the example of FIG. 13A.

Referring to FIGS. 13A and 13B, when the print medium P2 having the second thickness t2 greater than the first thickness t1 is introduced into the transfer nip N, the transfer roller 120 and the intermediate transfer belt 110 are apart from each other by the second thickness t2. At this time, a rotation center C1 of the transfer roller 120 moves by a second distance D2. The second distance D2 may be equal to or less than the second thickness t2. The second distance D2 may vary depending on elasticity of the outer surface of the transfer roller 120.

As the transfer roller 120 moves by the second distance D2, the gap between the movement guide structure 130 and the intermediate transfer belt 110 may have a second gap G2. The second gap G2 may be about 1.3 mm to about 2.1 mm.

As described above, depending on whether or not the print medium P is introduced into the transfer nip N or depending on the thickness of the print medium P when the print medium P is introduced into the transfer nip N, the transfer roller 120 moves in a direction intersecting the direction of introduction of the print medium P. The gap between the end 1301 of the movement guide structure 130 and the intermediate transfer belt 110 may be adjusted by using a force that appears when the transfer roller 120 moves. In response to a change in the thickness of the print medium P, the gap between the movement guide structure 130 and the intermediate transfer belt 110 is changed, so that it is possible to satisfy contrary conditions placed for the movement guide structure 130 according to the change in the thickness of the print medium P.

As various types of print media P are introduced into the transfer nip N, positional movement of the transfer roller 120 occurs, and the gap between the movement guide structure 130 and the intermediate transfer belt 110 may vary within a certain range. For example, when 0.1 mm thick print media P and 0.4 mm thick print media P are respectively introduced into the transfer nip N, the gap between the movement guide structure 130 and the intermediate transfer belt 110 may vary within about 0.4 mm to about 2.1 mm.

Figure 14:
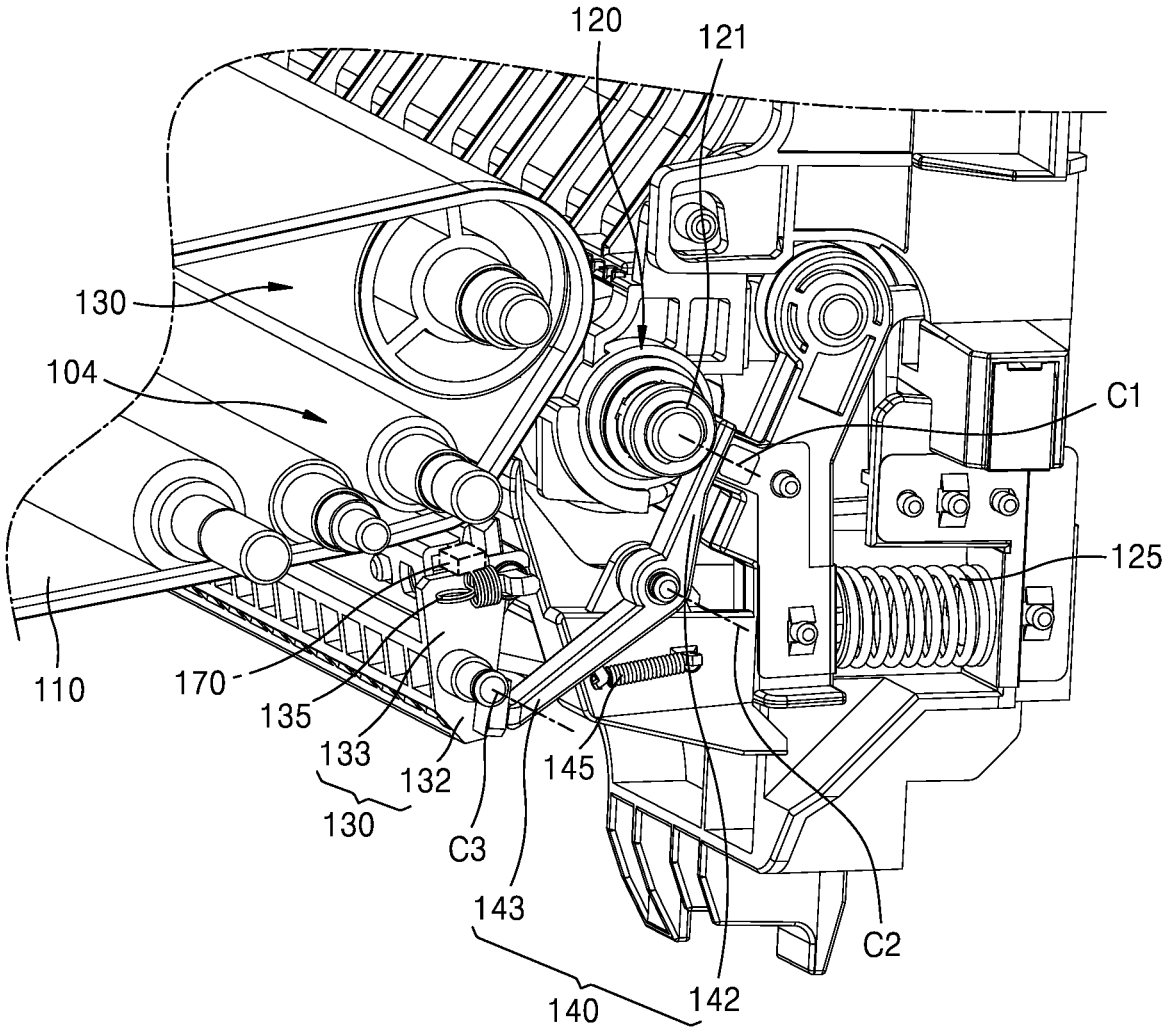
FIG. 14 is a partial perspective view for explaining a structure in which a movement guide structure moves in synchronization with movement of a transfer roller in an image forming apparatus according to an example.
Figure 15:
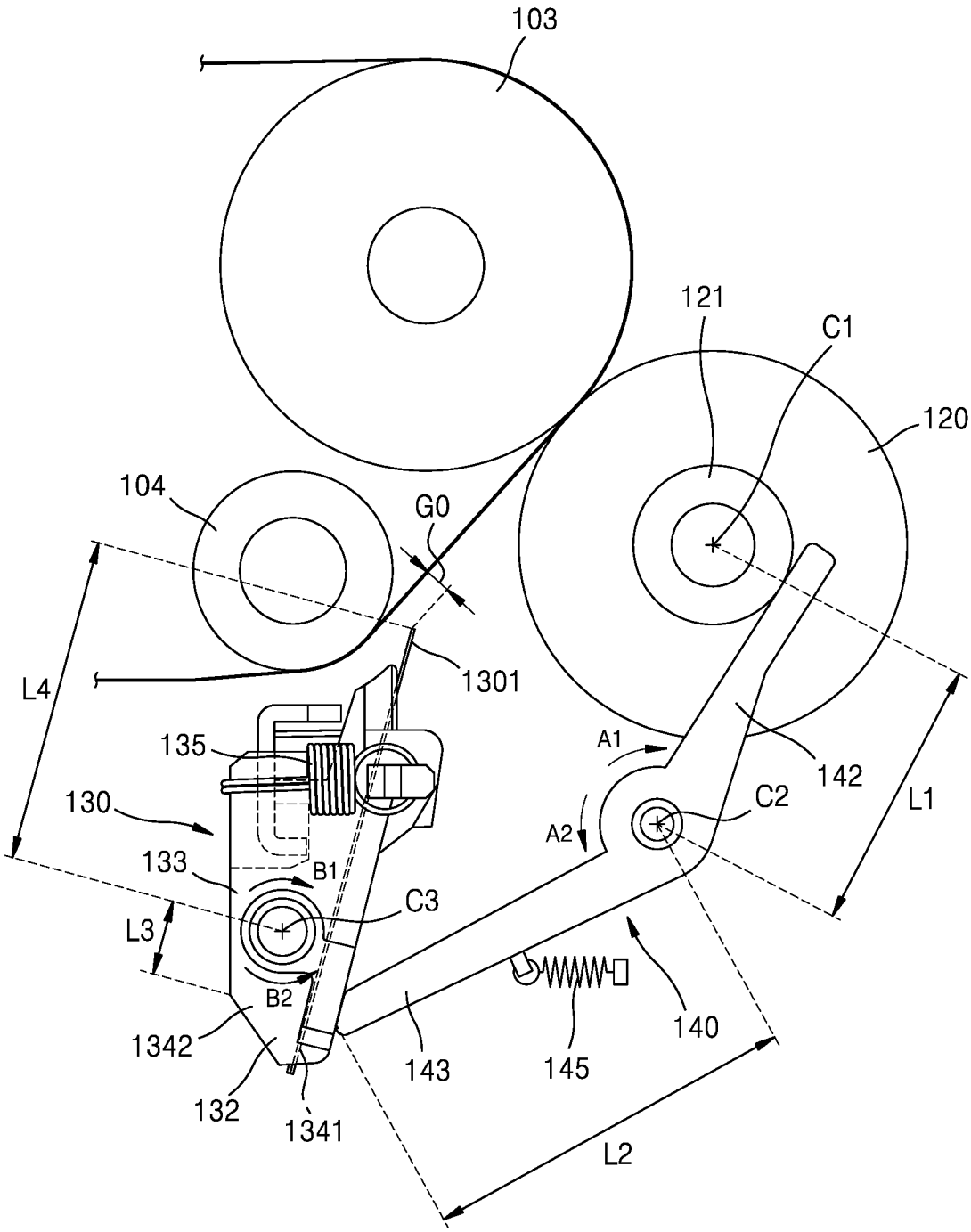
FIG. 15 is an example of a view for explaining operations of a transfer roller, a connecting link, and a movement guide structure in the image forming apparatus of FIG. 14.
Figure 16:
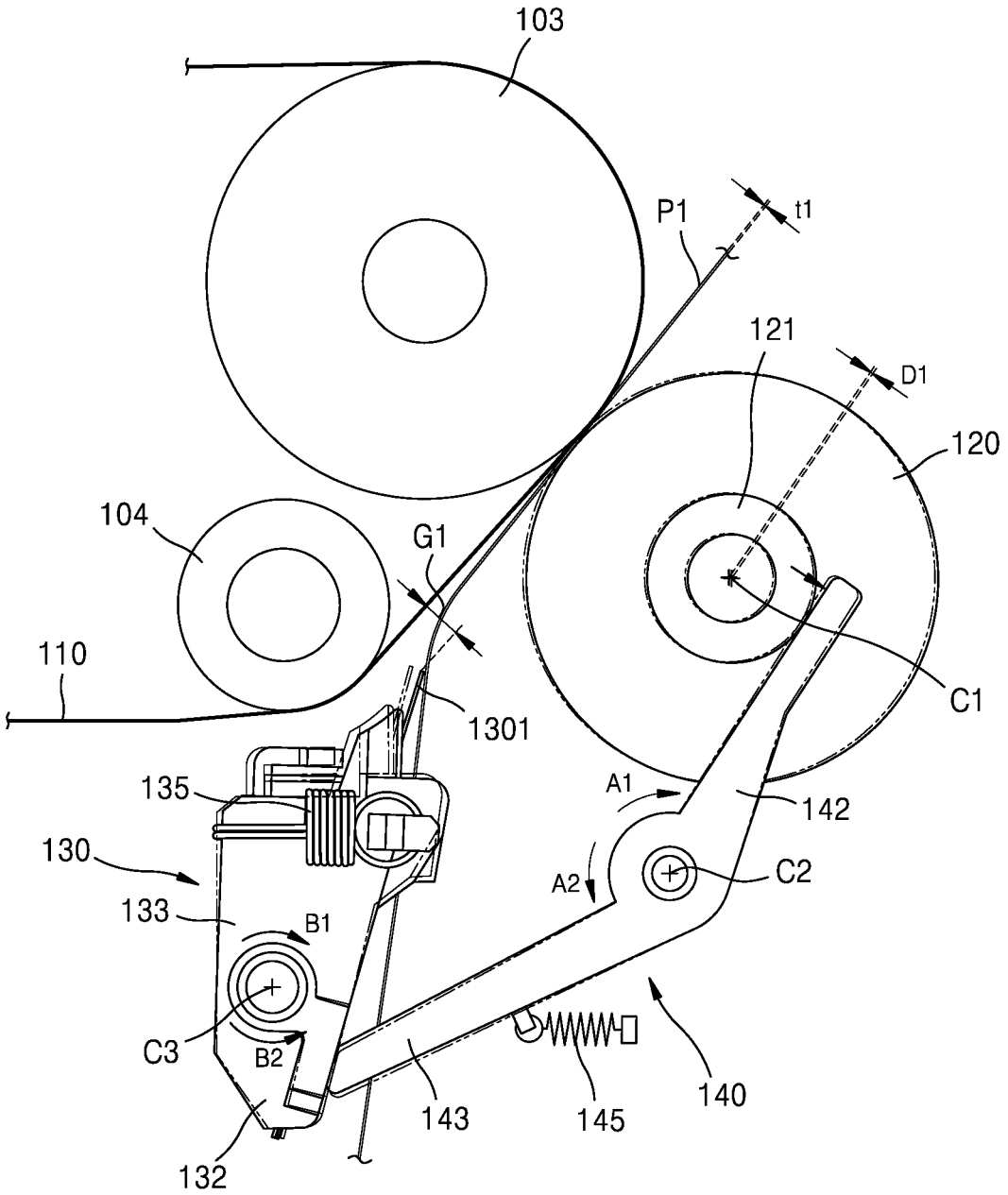
FIG. 16 is an example of a view for explaining operations of a transfer roller, a connecting link, and a movement guide structure when a general print medium is introduced into a transfer nip of the image forming apparatus of FIG. 15.
Figure 17:
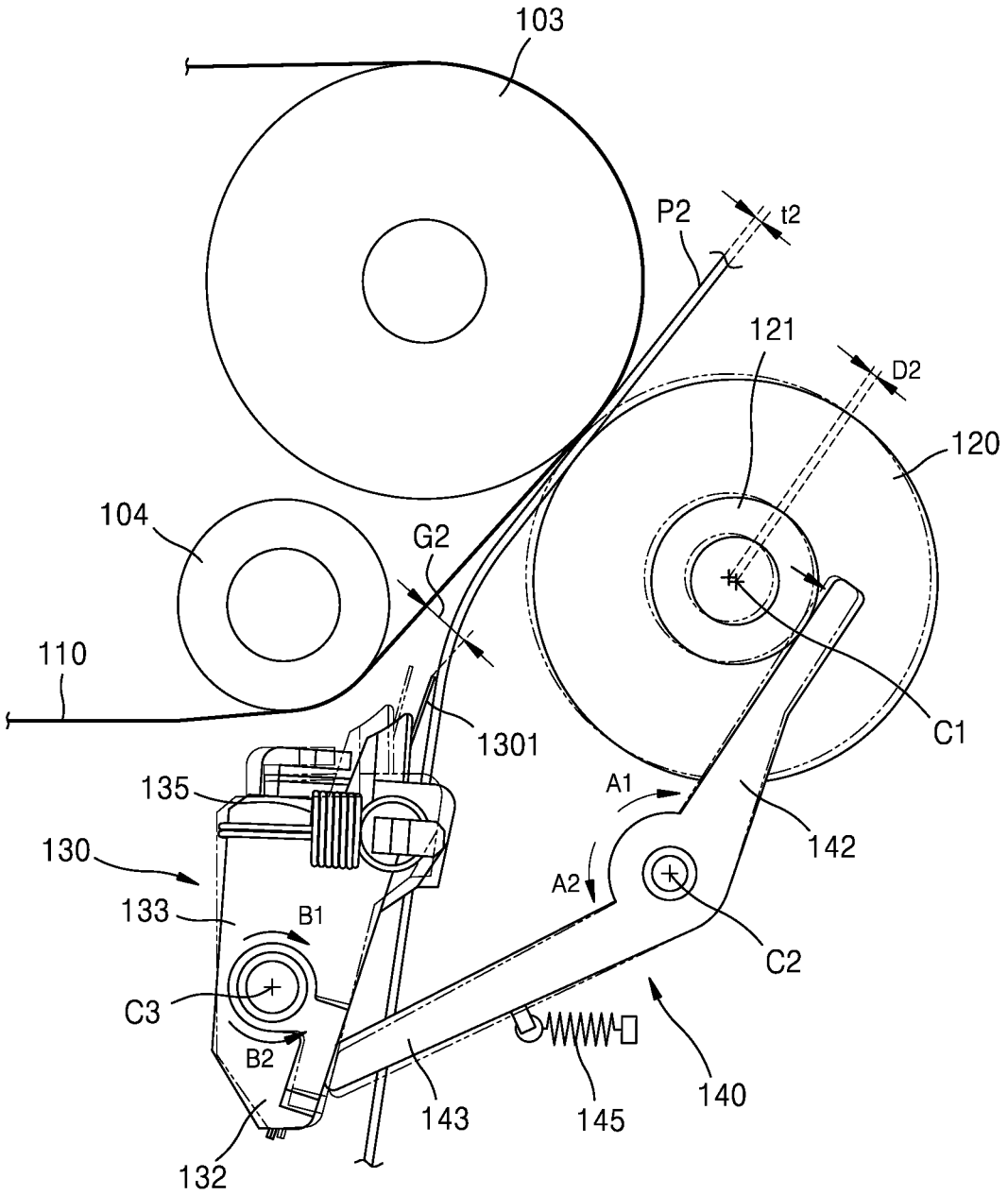
FIG. 17 is an example of a view for explaining operations of a transfer roller, a connecting link, and a movement guide structure when a thick print medium is introduced into a transfer nip of the image forming apparatus of FIG. 15.
Figure 18A:
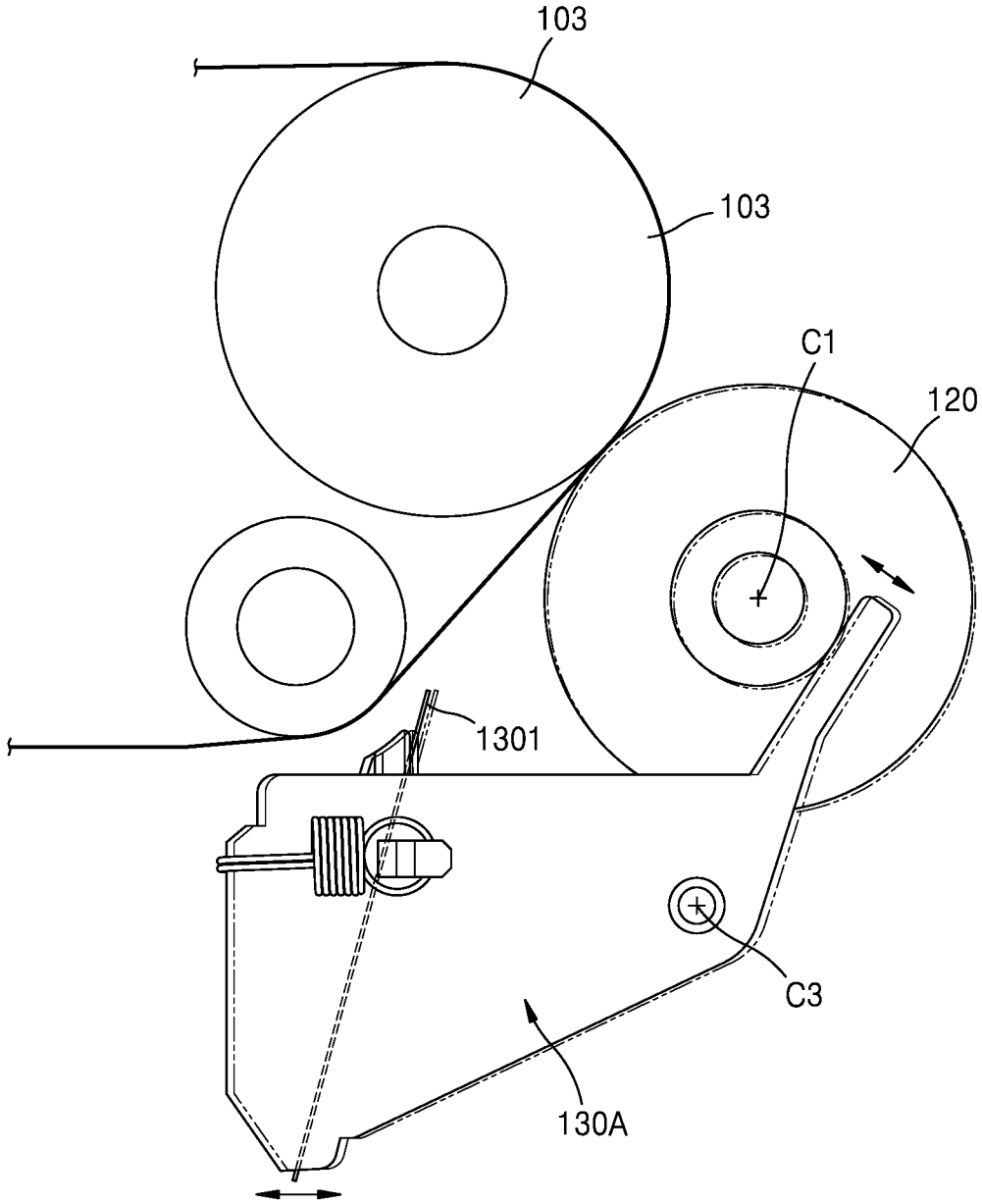
FIG. 18A and FIG. 18B are views for describing movement guide structures according to another example.
Figure 18B:
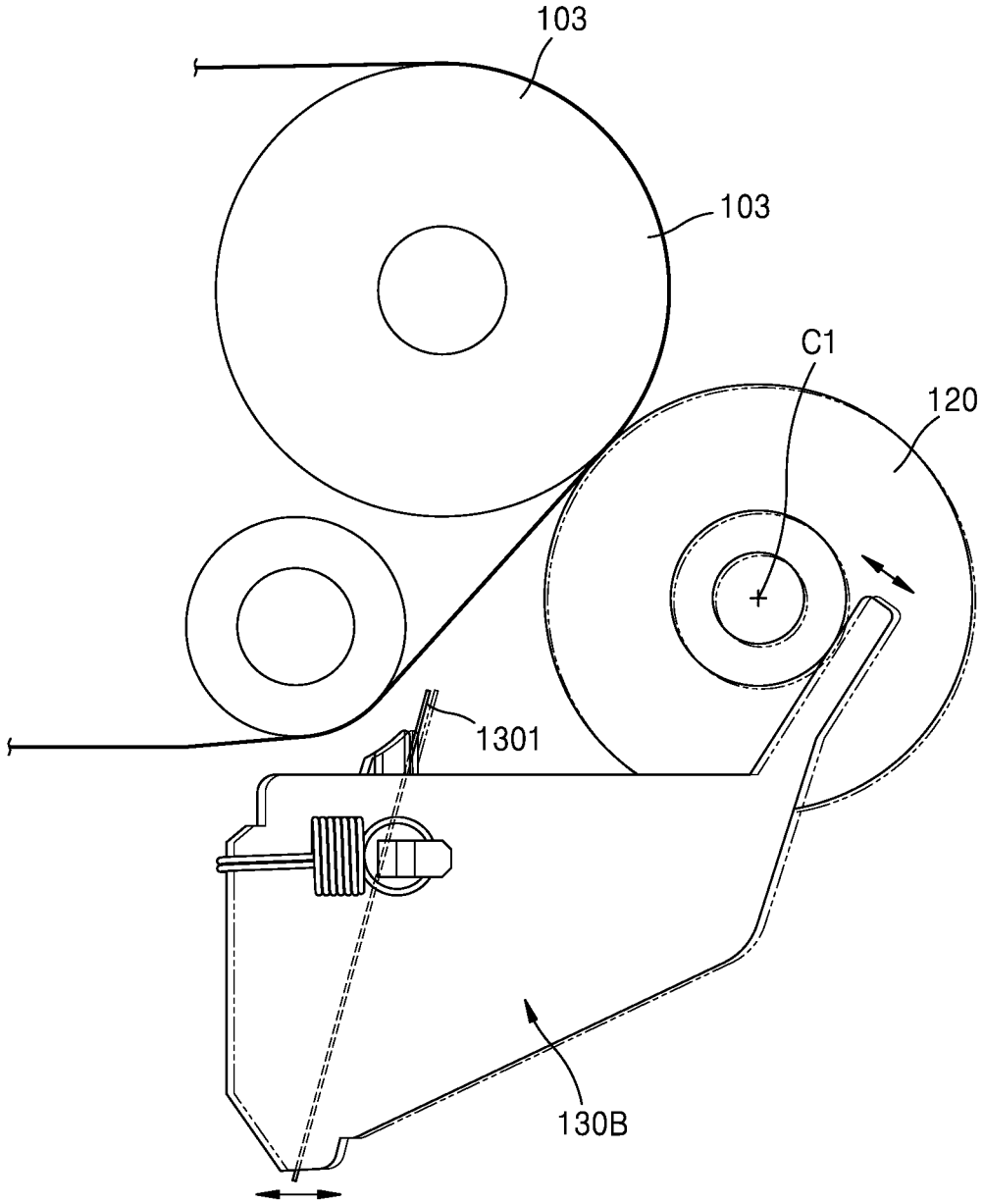
Figure 19:
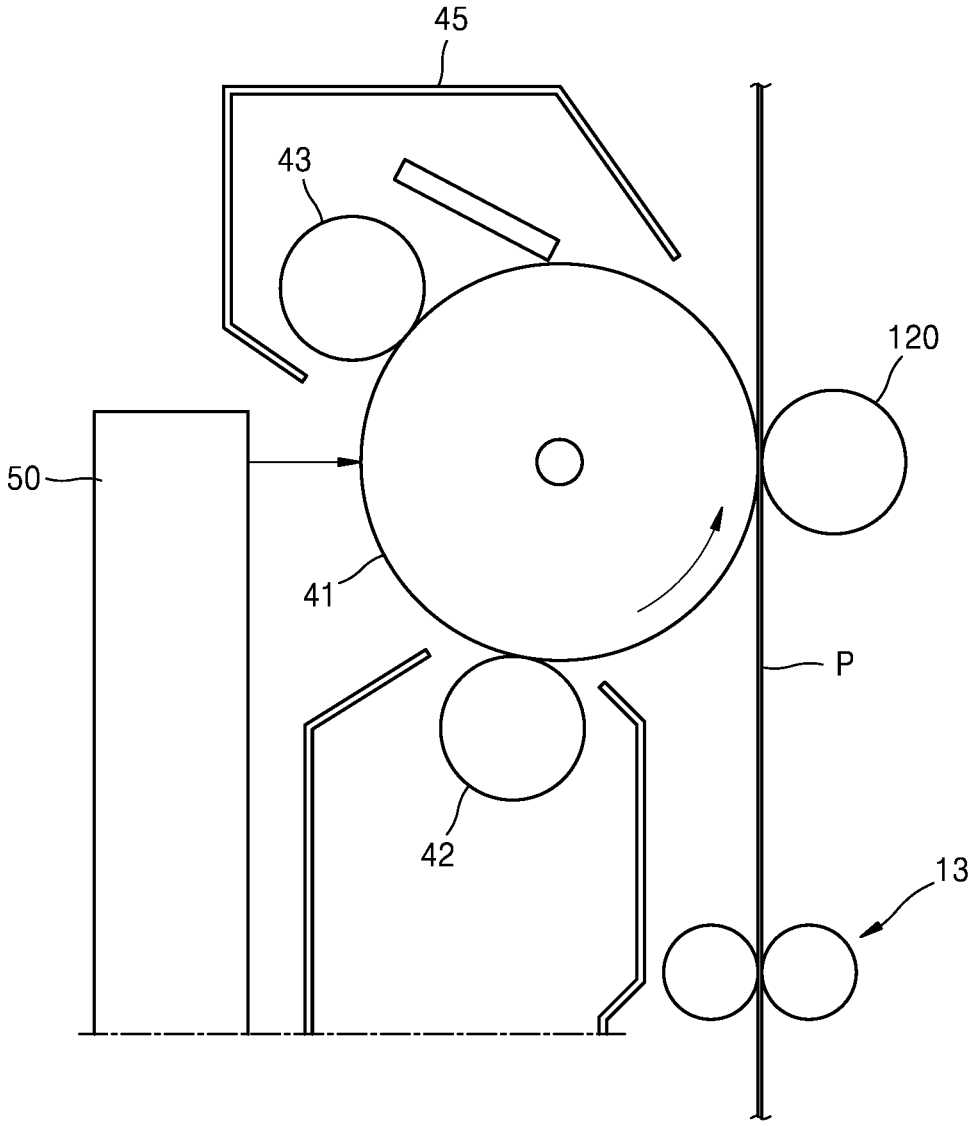
FIG. 19 is a view for explaining another transfer method according to an example.

FIG. 14 is a partial perspective view for explaining a structure in which the movement guide structure 130 moves in synchronization with movement of the transfer roller 120 in the image forming apparatus according to an example. FIGS. 15 to 17 are views for explaining operations of the transfer roller 120, a connecting link 140, and the movement guide structure 130 of FIG. 14. FIG. 18A and FIG. 18B are views for describing movement guide structures 130A and 130B according to another example; FIG. 19 is a view for explaining another transfer method.

Referring to FIGS. 14 and 15, the transfer roller 120 has a first rotating shaft 121 arranged at the rotation center C1. The transfer roller 120 is pressed by an elastic member 125 that provides an elastic force in a direction to maintain contact with the intermediate transfer belt 110 to form the intermediate transfer belt 110 with the transfer nip N.

In the transfer roller 120 having such a structure, when the print medium P is introduced into the transfer nip N, the first rotating shaft 121 moves in a direction away from the intermediate transfer belt 110. On the other hand, when there is no print medium P in the transfer nip N, for example, after the print medium P is withdrawn from the transfer nip N, the first rotating shaft 121 moves in a direction approaching the intermediate transfer belt 110. A moving distance of the first rotating shaft 121 is different according to the change in the thickness of the print medium P. The thicker the print medium P is, the larger the moving distance of the first rotating shaft 121 is.

Connecting links 140 may be arranged at both ends in the width direction of the print medium P of the transfer roller 120.

The connecting link 140 transfers positional movement of the transfer roller 120 to the movement guide structure 130. The connecting link 140 is rotated about a first rotation center C2 apart from the rotation center C1 of the transfer roller 120.

The connecting link 140 rotates in a first direction A1 in synchronization with positional movement of the first rotating shaft 121 of the transfer roller 120. For example, the connecting link 140 includes a first arm 142 extending from the first rotation center C2 and a second arm 143 extending from the first rotation center C2 in a different direction from that of a first arm 142 and arranged to face the movement guide structure 130. The first arm 142 and the second arm 143 are arranged in different directions from the first rotation center C2.

When the print medium P is introduced into the transfer nip N, the first arm 142 may be pressed by the first rotating shaft 121 of the transfer roller 120, and the second arm 143 may press the movement guide structure 130.

The connecting link 140 may be connected to a first elastic member 145 that provides an elastic force in a direction in which the first arm 142 approaches the first rotating shaft 121 of the transfer roller 120. For example, the first elastic member 145 may be connected to the second arm 143. Accordingly, when the print medium P is introduced into the transfer nip N, the first rotating shaft 121 of the transfer roller 120 pushes the first arm 142 so that the connecting link 140 is rotated in the first direction A1. When the print medium P is withdrawn from the transfer nip N, pressurization by the first rotating shaft 121 of the transfer roller 120 applied to the first arm 142 is released so that the connecting link 140 is rotated by the first elastic member 145 in a third direction A2 which is opposite to the first direction A1.

The movement guide structure 130 is pressed by the second arm 143 so that the end 1301 toward the intermediate transfer belt 110 moves.

The movement guide structure 130 may rotate about a second rotation center C3 apart from the rotation center C1 of the transfer roller 120.

For example, the movement guide structure 130 includes a third arm 132 extending from the second rotation center C3 and pressed by the second arm 143 and a fourth arm 133 extending from the second rotation center C3 in a different direction from that of the third arm 132 and arranged to face the intermediate transfer belt 110. The third arm 132 and the fourth arm 133 may be arranged in different directions from the second rotation center C3.

When the print medium P is introduced into the transfer nip N, the third arm 132 is pressed and moved by the second arm 143 by the positional movement of the first rotating shaft 121 and a rotation of the connecting link 140 in the first direction A1. Accordingly, the movement guide structure 130 may rotate in a second direction B1 about the second rotation center C3, may move such that the end 1301 of the fourth arm 133 is away from the surface of the intermediate transfer belt 110.

The movement guide structure 130 may be connected to a second elastic member 135 that provides an elastic force in a direction in which the fourth arm 133 approaches the intermediate transfer belt 110. For example, the second elastic member 135 may be connected to the fourth arm 133.

When the print medium P is withdrawn from the transfer nip N, pressurization by the second arm 143 of the connecting link 140 applied to the third arm 132 is released so that the movement guide structure 130 is rotated by the second elastic member 135 in a fourth direction B2 which is opposite to the second direction B1.

When the movement guide structure 130 is rotated in the fourth direction B2, a stopper 170 may be provided to limit a rotation range of the movement guide structure 130 such that the end 1301 does not contact the intermediate transfer belt 110 and maintains the reference gap G0.

Operation according to the above structure will be described with reference to FIGS. 15 to 17.

Referring to FIG. 15, when the print medium P is not introduced into the transfer nip N, the intermediate transfer belt 110 and the transfer roller 120 maintain contact by the elastic force provided by the elastic member 125 (see FIG. 14). At this time, because the connecting link 140 is pressed to rotate in a third direction A2 by the first elastic member 145, the first arm 142 is maintained in contact with the first rotating shaft 121 of the transfer roller 120. Because the movement guide structure 130 is pressurized to rotate in the fourth direction B2 by the second elastic member 135, the third arm 132 is maintained in contact with the second arm 143 of the connecting link 140.

Referring to FIG. 16, the print medium P1 of the first thickness t1 passes through the movement guide structure 130 and may be introduced into the transfer nip N. The first thickness t1 may be about 0.1 mm to about 0.2 mm.

As the print medium P1 of the first thickness t1 is introduced, in spite of the elastic force of the elastic member 125, the transfer roller 120 moves backward in a direction intersecting a direction of introduction of the print medium P1. As the transfer roller 120 moves, the first rotating shaft 121 arranged at the rotation center C1 of the transfer roller 120 moves in the same direction. A moving distance of the first rotating shaft 121 is the first distance D1. The first distance D1 may be about 0.1 mm to about 0.2 mm. The first distance D1 may be equal to or less than the first thickness t1. For example, when the first thickness t1 is about 0.1 mm to about 0.2 mm, the first distance D1 may be about 0.05 mm to about 0.15 mm. For example, the first distance D1 may be about 50% to about 100% of the first thickness t1.

The first arm 142 contacting the first rotating shaft 121 due to movement of the first rotating shaft 121 of the transfer roller 120 rotates about the first rotation center C2. Accordingly, the second arm 143 connected to the first arm 142 rotates about the first rotation center C2.

The third arm 132 contacting the second arm 143 due to the rotational movement of the second arm 143 rotates about the second rotation center C3. Accordingly, the fourth arm 133 connected to the third arm 132 rotates about the second rotation center C3.

Due to the rotational movement of the fourth arm 133, a gap between the intermediate transfer belt 110 and the end 1301 of the movement guide structure 130 is changed to the first gap G1 greater than the reference gap G0. For example, the first interval G1 may be 1.1 times to 1.9 times the reference gap G0.

Referring to FIG. 17, the print medium P2 having the second thickness t2 greater than the first thickness t1 passes through the movement guide structure 130 and may be introduced into the transfer nip N. The second thickness t2 is more than about 0.3 mm and may be about 5 mm or less.

As the print medium P1 of the second thickness t2 is introduced, in spite of the elastic force of the elastic member 125, the transfer roller 120 moves backward in a direction intersecting the direction of introduction of the print medium P1. As the transfer roller 120 moves, the first rotating shaft 121 arranged at the rotation center C1 of the transfer roller 120 moves in the same direction. The moving distance of the first rotating shaft 121 is the second distance D2 greater than the first distance D1. The second distance D2 is greater than about 0.3 mm and may be about 5 mm or less. The second distance D2 may be equal to or less than the second thickness t2. For example, when the second thickness t2 is about 0.4 mm, the first distance D1 may be about 0.2 mm to about 0.3 mm. For example, the second distance D2 may be about 50% to about 100% of the second thickness t2.

The first arm 142 contacting the first rotating shaft 121 by movement of the first rotating shaft 121 of the transfer roller 120 rotates about the first rotation center C2. Accordingly, the second arm 143 connected to the first arm 142 rotates about the first rotation center C2.

The third arm 132 contacting the second arm 143 due to the rotational movement of the second arm 143 rotates about the second rotation center C3. Accordingly, the fourth arm 133 connected to the third arm 132 rotates about the second rotation center C3.

Due to the rotational movement of the fourth arm 133, a gap between the intermediate transfer belt 110 and the end 1301 of the movement guide structure 130 is changed to the second gap G2 greater than the reference gap G0. For example, the second interval G2 may be about 1.4 times to about 3 times the reference gap G0.

Meanwhile, a difference between the reference gap G0, which is a gap between the end 1301 of the movement guide structure 130 and the intermediate transfer belt 110 as an image carrying member when the print media P1 and P2 are not introduced into the transfer nip N, and the first gap G1 or the second gap G2, which is a gap between the end 1301 of the movement guide structure 130 and the intermediate transfer belt 110 as an image carrying member when the print media P1 and P2 are introduced into the transfer nip N, may be greater than a thickness of the introduced print media P1 and P2. For example, the difference between the first gap G1 and the reference gap G0 may be about 1.5 times to about 8 times the first thickness t1. For example, the difference between the second gap G2 and the reference gap G0 may be about 1.5 times to about 8 times the second thickness t2.

As such, when a moving distance of the end 1301 of the movement guide structure 130 is greater than the thickness of the print media P1 and P2, despite a small change in the thickness of the print media P1 and P2, the end 1301 of the movement guide structure 130 may be moved to satisfy opposite conditions placed for the movement guide structure 130.

Accordingly, the connecting link 140 and the movement guide structure 130 may be designed in consideration of the thickness of the print media P1 and P2 and a movement range placed or put on for the movement guide structure 130.

Referring again to FIG. 15, for example, a distance L1 from the first rotation center C2 to a point where the first arm 142 acts on the first rotating shaft 121 may be less than a distance L2 from the first rotation center C2 to a point where the second arm 143 contacts the third arm 132. The distance L1 may be about 30% or more and about 90% or less of the distance L2. For example, the distance L1 may be about 50% or more and about 80% or less of the distance L2.

A distance L3 from the second rotation center C3 to a point where a pressing force by the second arm 143 acts on the third arm 132 may be less than a distance L4 from the second rotation center C3 to the end 1301 of the fourth arm 133. For example, the distance L3 may be about 5% or more and about 50% or less of the distance L4. For example, the distance L3 may be about 10% or more and about 25% or less of the distance L4.

By designing the distance L1 of the connecting link 140 is less than the distance L2 and the distance L3 of the movement guide structure 130 is less than the distance L4, the end 1301 of the movement guide structure 130 may be moved by a distance greater than a moving distance of the transfer roller 120.

Thus, in the image forming apparatus 1 according to an example, through a mechanical structure synchronized with the movement of the transfer roller 120 in which a thickness change of the print medium P occurs without a sophisticated sensor member used to detect the thickness of the separate print medium P, the distance between the end 1301 of the movement guide structure 130 and the intermediate transfer belt 110 may be changed.

Meanwhile, referring again to FIGS. 11A and 11B and 15, the intermediate transfer belt 110 is arranged adjacent to the movement guide structure 130 and the guide structure 150. For example, a distance between the intermediate transfer belt 110 and an end of the guide structure 150 may be about 2 mm to about 10 mm. For example, a distance G4 between the intermediate transfer belt 110 and the end of the guide structure 150 may be about 2 mm to about 5 mm. Accordingly, a space for the arrangement of the movement guide structure 130 between the intermediate transfer belt 110 and the guide structure 150 may be quite narrow. As described above, the movement guide structure 130 may be designed in consideration of arranging the movement guide structure 130 in which the end 1301 is movable in a narrow space.

For example, the movement guide structure 130 may further include a rotating body 1342 that rotates about the second rotation center C3 and a guide sheet 1341 protruding from the rotating body 1342 toward the intermediate transfer belt 110. A portion of the guide sheet 1341 and the rotating body 1342 constitute the third arm 132, and the other portion of the guide sheet 1341 and the rotating body 1342 may constitute the fourth arm 133.

A portion of the guide sheet 1341 is supported by the rotating body 1342 and the other portion may protrude from the rotating body 1342 toward the intermediate transfer belt 110.

The protruding portion of the guide sheet 1341 may be elastically deformed.

A thickness of the guide sheet 1341 may be about 0.05 mm to about 0.4 mm. By making the thickness of the guide sheet 1341 thin, the guide sheet 1341 may be located within a relatively narrow gap between the intermediate transfer belt 110 and the guide structure 150 to guide the print medium P.

In the above-described example, the description has been focused on a structure in which the movement guide structure 130 is pressed and moved by the connecting link 140. However, connection between the movement guide structure 130 and the transfer roller 120 is not necessarily limited thereto.

For example, as illustrated in FIG. 18A, a movement guide structure 130A may have a structure that contacts the transfer roller 120 without the connecting link 140. The movement guide structure 130A may move in a certain direction by movement of the transfer roller 120. The movement guide structure 130A may rotate and move about the second rotation center C3 apart from the rotation center C1 of the transfer roller 120. As another example, as shown in FIG. 18B, a movement guide structure 130B may be slidably moved without rotation in a certain direction by the movement of the transfer roller 120.

In the examples disclosed in FIGS. 1 to 18B, the structure in which the print medium P is transferred by the intermediate transfer belt 110 has been mainly described. However, a transfer method for image formation is not limited thereto, and as shown in FIG. 19, a transfer method that is transferred directly from the photosensitive drum 41 to the print medium P without the intermediate transfer belt 110 may be used. In this case, a toner image is arranged on a surface of the photosensitive drum 41 instead of the intermediate transfer belt 110, and the surface may rotate and move. In this case, the photosensitive drum 41 may be an image carrying member.

Meanwhile, the above-described examples disclose an example of adjusting the movement of the movement guide structures 130, 130A, and 130B through a mechanical structure synchronized with the transfer roller 120, the position of which moves according to a change in the thickness of the print medium P. However, the disclosure is not limited thereto, and may be applied to various structures.

Figure 20:
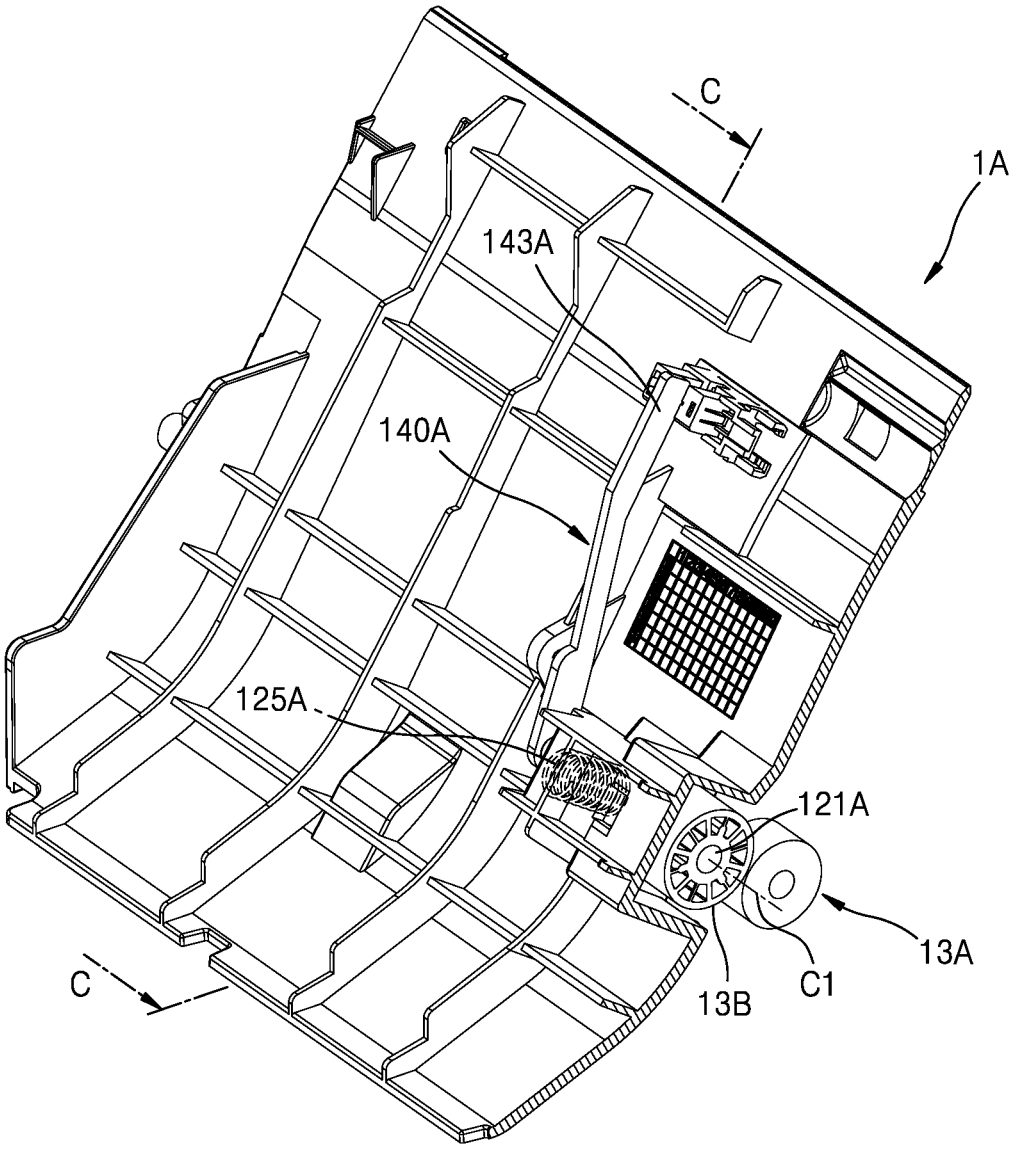
FIG. 20 is a perspective view for explaining an image forming apparatus according to another example.
Figure 21:
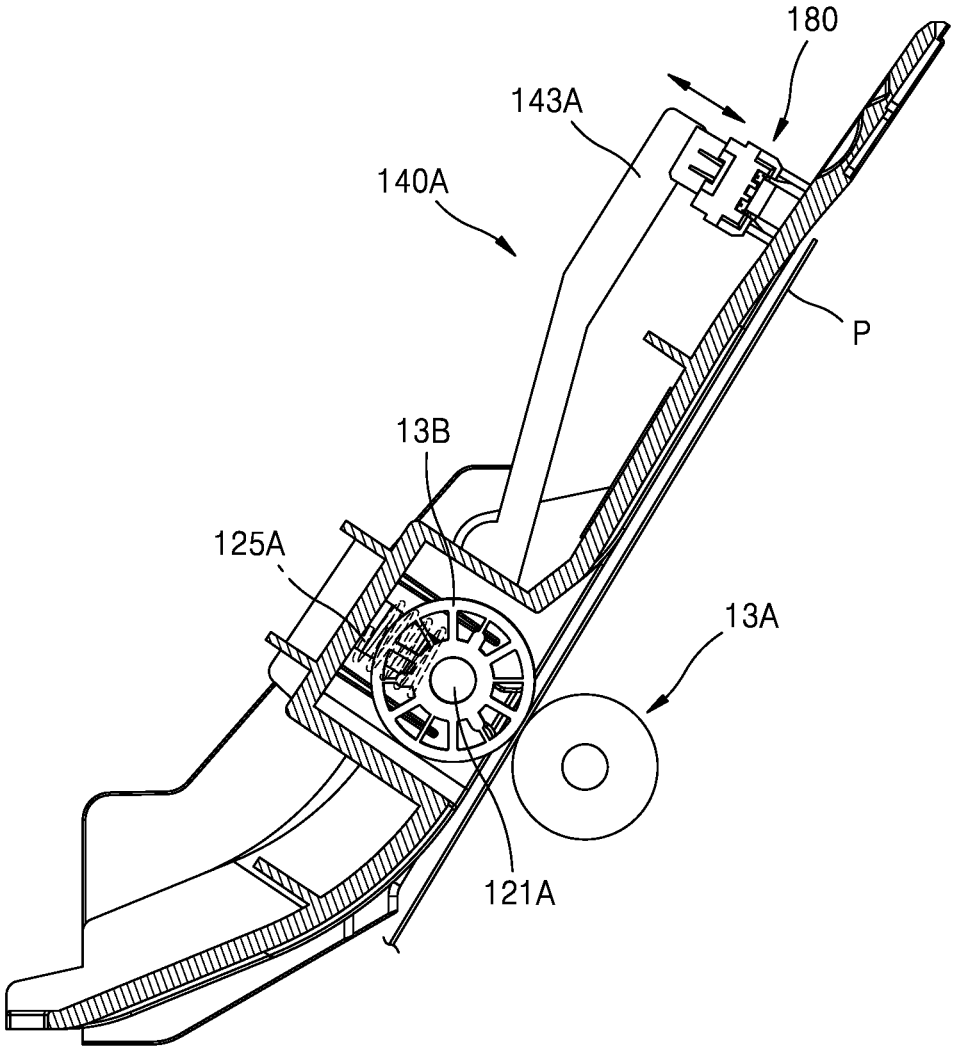
FIG. 21 is a side view of the example of the image forming apparatus of FIG. 20 as viewed from one side.
Figure 22:
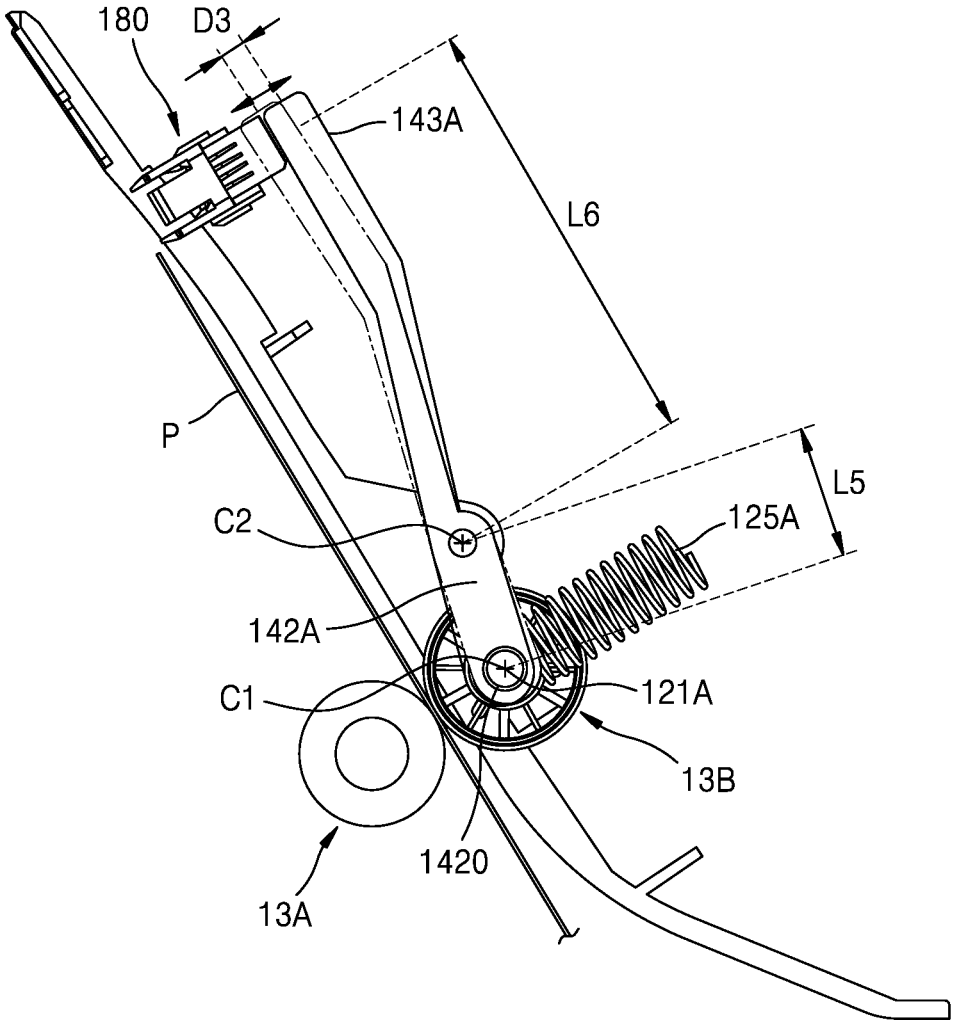
FIG. 22 is an example of a cross-sectional view of the image forming apparatus taken along a line C-C of FIG. 20.

FIG. 20 is a perspective view for explaining an image forming apparatus 1A according to another example, FIG. 21 is a side view of the image forming apparatus 1A of FIG. 20 as viewed from one side, and FIG. 22 is a cross-sectional view of the image forming apparatus 1A taken along line C-C in FIG. 20. In FIG. 20, for convenience of description, a portion of the image forming apparatus 1A is illustrated, and the rest of the general configuration is omitted.

Referring to FIGS. 20 to 22, the image forming apparatus 1A according to an example may include a first rotating member 13A, a second rotating member 13B facing the first rotating member 13A, wherein the print medium P is introduced between the first rotating member 13A and the second rotating member 13B, and moving in a direction intersecting the direction of introduction of the print medium P according to a thickness of the introduced print medium P, and a thickness detector 180 detecting the thickness of the introduced print medium P based on a moving distance of the second rotating member 13B.

As the print medium P is introduced between the first rotating member 13A and the second rotating member 13B, a rotating shaft 121A arranged at the rotation center C1 of the second rotation member 13B moves in a direction intersecting the direction of introduction of the print medium P. The rotating shaft 121A of the second rotating member 13B is pressed toward the first rotating member 13A by an elastic member 125A.

The second rotating member 13B has a different moving distance depending on the thickness of the print medium P. For example, when the print medium P1 (see FIG. 16) of the first thickness t1 is introduced between the first rotating member 13A and the second rotating member 13B, the rotating shaft 121A of the second rotating member 13B moves by the first distance D1. When the print medium P2 (see FIG. 17) of the second thickness t2 is introduced between the first rotating member 13A and the second rotating member 13B, the rotating shaft 121A of the second rotating member 13B moves by the second distance D2.

The thickness detector 180 may detect the thickness of the printed medium P, based on a moving distance of the rotating shaft 121A of the second rotating member 13B. Here, the detecting of the thickness includes determining whether the thickness is thick enough to exceed a certain criterion as well as calculating a thickness value.

As an example, when the moving distance of the rotating shaft 121A of the second rotating member 13B is less than a certain distance, the thickness detector 180 may detect that the print medium P is a general print medium P1 having a relatively thin thickness. When the moving distance of the rotating shaft 121A of the second rotating member 13B is greater than a certain distance, the thickness detector 180 may detect that the print medium P is a general print medium P2 having a relatively thick thickness.

As another example, the thickness value of the print medium P may be calculated in proportion to the moving distance of the rotating shaft 121A of the second rotating member 13B.

A connecting link 140A may be arranged between the rotating shaft 121A of the second rotating member 13B and the thickness detector 180. The connecting link 140A may rotate about the first rotation center C2 in synchronization with the movement of the rotation axis 121A of the second rotation member 13B.

As an example, the connecting link 140A may include a first arm 142A and a second arm 143A extending in different directions from the first rotation center C2. The first arm 142A is connected to the rotating shaft 121A of the second rotating member 13B. As an example, the first arm 142A may include an insertion hole 1420 into which the rotating shaft 121A of the second rotating member 13B is inserted. The second arm 143A is arranged adjacent to the thickness detector 180.

The first arm 142A rotates about the first rotation center C2 by positional movement of the rotating shaft 121A of the second rotation member 13B. Accordingly, the second arm 143A connected to the first arm 142A rotates about the first rotation center C2.

A distance L6 from the first rotation center C2 to a point where the second arm 143A is inserted into the thickness detector 180 may be greater than a distance L5 from the first rotation center C2 to a point where a force of the rotating shaft 121A acts on the first arm 142A. For example, the distance L6 from the first rotation center C2 to the point where the second arm 143A is inserted into the thickness detector 180 may be about 2.5 times to about 5.5 times the distance L5 from the first rotation center C2 to the point where the force of the rotating shaft 121A acts on the first arm 142A.

Through this, a moving distance D3 of the second arm 143A may be increased from the moving distance of the rotating shaft 121A of the second rotating member 13B. For example, a moving distance of an area adjacent to the thickness detector 180 in the second arm 143A may be increased from about 2.5 times to about 5.5 times the moving distance of the rotating shaft 121A of the second rotating member 13B.

As an example, the thickness detector 180 may selectively detect whether the second arm 143A is moved according to the thickness of the print medium P.

For example, when the thickness of the print medium P is less than or equal to a certain criterion, the moving distance of the rotating shaft 121A of the second rotating member 13B is relatively small, and accordingly, the moving distance D3 of the second arm 143A is also small. The certain criterion may be, for example, about 0.3 mm or less. The certain criterion may be, for example, about 0.2 mm or less.

When the moving distance D3 of the second arm 143A is small, the thickness detector 180 does not detect the movement of the second arm 143A. In this case, the thickness detector 180 may detect the introduced print medium P as a general print medium P1.

Meanwhile, when the thickness of the print medium P exceeds a certain criterion, the moving distance of the rotating shaft 121A of the second rotating member 13B is relatively large, and accordingly, the moving distance D3 of the second arm 143A is also large. When the moving distance D3 of the second arm 143A is equal to or greater than a certain size, the thickness detector 180 detects the movement of the second arm 143A. When the movement of the second arm 143A is detected, the thickness detector 180 may identify the introduced print medium P as a thick print medium P2.

The thickness detector 180 may be a photo sensor. However, the thickness detector 180 is not limited thereto, and any sensor for detecting whether the second arm 143A is moving or the amount of movement of the second arm 143A may be applied in various ways.

As another example, the thickness detector 180 may detect the moving distance of the second arm 143A.

For example, the thickness detector 180 may detect the moving distance of the second arm 143A and identify a thickness value of the print medium P corresponding to the detected moving distance. By setting the thickness of the print medium P corresponding to the detected moving distance of the second arm 143A in advance, the thickness of the print medium P may be calculated in accordance with the detected moving distance of the second arm 143A. Because the thickness calculation uses a well-known method, detailed description thereof is omitted.

As such, in the image forming apparatus 1A according to an example, a method of detecting the thickness of the print medium P is used based on the movement of the second rotating member 13B, which is a structure in which mechanical movement occurs according to a change in the thickness of the print medium P. Through this, it is possible to minimize an error of the thickness detection of the print medium P.

When the thickness detector 180 directly detects the thickness of the print medium P, a detection error may occur depending on printing conditions. For example, it is possible to consider a method in which the thickness detector 180 directly irradiates an ultrasonic signal to the print medium P and detects the thickness of the print medium P through reflected ultrasonic waves In this case, ultrasonic signal detection may be inaccurate due to various factors such as shaking of the print medium P that is rapidly transferred and changes in surrounding environmental conditions.

On the other hand, by using a structure in which mechanical movement occurs when the thickness of the print medium P changes, it is possible to compensate to some extent an error or inaccuracy in signal detection that may occur in a process of detecting the thickness of the print medium P.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. An image forming apparatus comprising:

an image carrying member including a movable surface to include a toner image;

a transfer roller to form a transfer nip between the transfer roller and the movable surface of the image carrying member, to move position in a direction in correspondence to a thickness of a print medium to intersect a direction of introduction of the print medium into the transfer nip, and to receive a transfer bias voltage to transfer the toner image from the movable surface of the image carrying member to the print medium; and a movement guide structure to guide the print medium toward the transfer nip, and to move in synchronization with the movement of the position of the transfer roller to change a gap between an end of the movement guide structure facing the image carrying member and the image carrying member.

2. The image forming apparatus of claim 1, wherein, as the thickness of the introduced print medium increases, the gap between the end of the movement guide structure and the image carrying member increases.

3. The image forming apparatus of claim 2, wherein a difference between a gap between the end of the movement guide structure and the image carrying member in which a print medium is not introduced into the transfer nip and a gap between the end of the movement guide structure and the image carrying member in which a print medium is introduced into the transfer nip is greater than the thickness of the introduced print medium.

4. The image forming apparatus of claim 2, further comprising a connecting link to transfer the positional movement of the transfer roller to the movement guide structure, the connecting link to rotate about a first rotation center apart from a rotation center of the transfer roller, and comprises a first arm to extend from the first rotation center and to be pressed by the transfer roller, and a second arm to extend from the first rotation center in a different direction from that of the first arm and to face the movement guide structure.

5. The image forming apparatus of claim 4, wherein a distance from a point where the first arm is pressed by the transfer roller to the first rotation center is less than a distance from a point where the second arm contacts the movement guide structure to the first rotation center.

6. The image forming apparatus of claim 4, wherein the movement guide structure to rotate about a second rotation center apart from the rotation center of the transfer roller, and comprises a third arm to extend from the second rotation center and to be pressed by the second arm, and a fourth arm to extend from the second rotation center in a different direction from that of the third arm and to face the movement guide structure.

7. The image forming apparatus of claim 6, wherein a distance from the end facing the image carrying member to the second rotational center in the fourth arm is greater than a distance from a point where the third arm is pressed by the second arm to the second rotational center.

8. The image forming apparatus of claim 6, wherein the movement guide structure comprises:

an elastic member to provide an elastic force such that the fourth arm moves toward the image carrying member; and a stopper to limit a rotation range of the movement guide structure.

9. The image forming apparatus of claim 1, wherein the movement guide structure comprises:

a rotating body to rotate about a second rotation center apart from a rotation center of the transfer roller; and a guide sheet having a thickness less than a thickness of the rotating body and protruding from the rotating body toward the image carrying member.

10. The image forming apparatus of claim 9, wherein the thickness of the guide sheet is about 0.05 mm to about 0.4 mm.

11. The image forming apparatus of claim 10, further comprising:

a pair of conveying rollers upstream of a transfer path of the print medium to transfer the print medium between the image carrying member and the transfer roller; and a guide structure between the conveying rollers and the transfer roller and facing a second surface opposite to a first surface of the print medium guided by the movement guide structure.

12. The image forming apparatus of claim 11, wherein a gap between the guide structure and the movement guide structure is gradually narrowed along the transfer path of the print medium.

13. The image forming apparatus of claim 12, wherein a distance between an end of the guide structure and the image carrying member is 2 mm to 10 mm.

* * * * *